US007983584B2

(12) United States Patent
Okamoto et al.

(10) Patent No.: US 7,983,584 B2
(45) Date of Patent: Jul. 19, 2011

(54) IMAGE FORMING APPARATUS AND CONTROL METHOD THEREFOR

(75) Inventors: Kiyoshi Okamoto, Moriya (JP); Mitsuhiko Sato, Kashiwa (JP); Yuichiro Maeda, Kashiwa (JP); Kiyoharu Kakomura, Toride (JP); Hidenori Sunada, Toride (JP)

(73) Assignee: Canon Kabushiki Kaisha (JP)

( * ) Notice: Subject to any disclaimer, the term of this patent is extended or adjusted under 35 U.S.C. 154(b) by 416 days.

(21) Appl. No.: 12/245,766

(22) Filed: Oct. 5, 2008

(65) Prior Publication Data

US 2009/0092406 A1 Apr. 9, 2009

(30) Foreign Application Priority Data

Oct. 5, 2007 (JP) ..... 2007-262526

(51) Int. Cl.
*G03G 15/00* (2006.01)

(52) U.S. Cl. ..... 399/82

(58) Field of Classification Search ..... 399/82
See application file for complete search history.

(56) References Cited

U.S. PATENT DOCUMENTS 5,245,397 A * 9/1993 Mahoney ..... 399/402

FOREIGN PATENT DOCUMENTS

JP 8-133587 A 5/1996
JP 2002-3063 A 1/2002

* cited by examiner

*Primary Examiner* — David M Gray
*Assistant Examiner* — Erika Villaluna
(74) *Attorney, Agent, or Firm* — Rossi, Kimms & McDowell LLP

(57) ABSTRACT

An image forming apparatus in which surplus tabbed sheets produced in one set of output can be utilized for the next set of output, without requiring a user to perform a laborious task. In the image forming apparatus, a CPU calculates the number of tabbed sheet groups which will be used for one set of image formation and the number of tabbed sheets which will be used from among the last tabbed sheet group. Among the last tabbed sheet group, surplus tabbed sheets which will be left unused in the one set of image formation are determined. If the number of tabbed sheets is equal to or less than the number of the surplus tabbed sheets, at least one of the surplus tabbed sheets is used to carry out two sets of image formation.

6 Claims, 19 Drawing Sheets

IMAGE FORMING APPARATUS AND CONTROL METHOD THEREFOR

BACKGROUND OF THE INVENTION

1. Field of the Invention

The present invention relates to an image forming apparatus for image formation on tabbed sheets, and a control method therefor.

2. Description of the Related Art

Conventionally, some image forming apparatus comprises a tabbed sheet creation mode in which tabbed sheets are formed with corresponding images.

The tabbed sheet creation mode will be described with reference to FIGS. 18A-21. FIGS. 18A and 18B show how tabbed sheets are arranged in a tabbed sheet group, which consists of seven tabbed sheets. FIG. 19 schematically shows how a plurality of tabbed sheet groups are loaded on a sheet feed tray of an image forming apparatus. FIG. 20 shows an example of image formation on two tabbed sheets by using a tabbed sheet group consisting of seven tabbed sheets. FIG. 21 shows an example of image formation on nine tabbed sheets by using a plurality of tabbed sheet groups each consisting of seven tabbed sheets.

As shown for example in FIG. 18A, there is on the market a tabbed sheet group consisting of seven tabbed sheets having respective tabs formed therein at different positions. In this tabbed sheet group, tabbed sheets are arranged in a decreasing order of tab position. Besides, there is a tabbed sheet group consisting of tabbed sheets arranged in an increasing order of tab position, as shown in FIG. 18B.

When loaded onto a sheet feed tray of an image forming apparatus, the tabbed sheet groups are loaded on a per-group basis as shown in FIG. 19. In the example in FIG. 19, there are loaded on the tray a plurality of tabbed sheet groups each of which corresponds to the tabbed sheet group shown in FIG. 18A.

At the image formation on the first two of seven tabbed sheets of the tabbed sheet group, the first two tabbed sheets P1-P2 are respectively formed with corresponding images "1" and "2" as shown in FIG. 20. The remaining five tabbed sheets P3-P7 are not fed, but remain retained as surplus tabbed sheets in the sheet feed tray.

As described above, the number of tabbed sheets formed with images is sometimes less than the number of tabbed sheets constituting the tabbed sheet group, and surplus tabbed sheets remain in the sheet feed tray. A technical art has therefore been proposed for discharging surplus tabbed sheets to a sheet discharge tray different from that for tabbed sheets formed with images (see, for example, Japanese Laid-open Patent Publication No. 2002-3063).

It is assumed here that a plurality of tabbed sheet groups each consisting of, e.g., seven tabbed sheets are loaded onto a sheet feed tray, and images are formed on respective ones of the first two tabbed sheets. In this case, two tabbed sheets of the first tabbed sheet group are fed in sequence and respectively formed with corresponding images. The tabbed sheets formed with the images are discharged to a first sheet discharge tray. The remaining five tabbed sheets of the first tabbed sheet group are discharged as surplus tabbed sheets to a second sheet discharge tray different from the first sheet discharge tray.

When image formation for a second set is performed in succession to the image formation for a first set, the first two of tabbed sheets of a second tabbed sheet group are respectively formed with corresponding images, and the tabbed sheets formed with the images are discharged to the first sheet discharge tray. The remaining five tabbed sheets are discharged as surplus tabbed sheets to the second sheet discharge tray.

It is assumed here that a plurality of tabbed sheet groups each consisting of seven tabbed sheets are loaded onto the sheet feed tray, and a setting for image formation on nine tabbed sheets is performed by a user. In this case, as shown in FIG. 21, the first to seventh tabbed sheets P1-P7 of the first tabbed sheet group are formed with corresponding images "1" to "7". In succession, images "8" and "9" are respectively formed on the first two P8, P9 of tabbed sheets of the second tabbed sheet group. The tabbed sheets P1-P9 are discharged to the first sheet discharge tray. On the other hand, the remaining five tabbed sheets P10-P14 of the second tabbed sheet group are discharged as surplus tabbed sheets to the second sheet discharge tray.

In the case of producing plural sets of output, surplus tabbed sheets are discharged in each set of output as described above, resulting in a large number of surplus tabbed sheets. In some cases, surplus tabbed sheets produced in each set of output include tabbed sheets that can be sorted for reutilization for the next set of output. In that case, a tabbed sheet group can be reconstructed by the user by sorting the surplus tabbed sheets.

However, to reutilize a reconstructed tabbed sheet group for the next set of output, the user is required to reconstruct a tabbed sheet group using reusable surplus tabbed sheets and load the reconstructed tabbed sheet group onto a sheet feed tray after each set of output, which is quite laborious.

SUMMARY OF THE INVENTION

The present invention provides an image forming apparatus for image formation on tabbed sheets, and a control method therefor.

According to a first aspect of this invention, there is provided an image forming apparatus comprising a feeding unit adapted to store at least one tabbed sheet group, each of the at least one tabbed sheet group consisting of a plurality of tabbed sheets having tabs formed therein at different positions, the feeding unit being adapted to feed the stored tabbed sheets, a refeeding unit adapted to reverse front and back sides of the tabbed sheets fed from the feeding unit and adapted to feed the reversed tabbed sheets, an image processing unit adapted to perform rotation processing to rotate an image to a predetermined direction and perform sorting processing to sort images on a plurality of pages into a predetermined order, and a control unit adapted to control the image forming apparatus and adapted to determine number of tabbed sheets constituting one tabbed sheet group and number of tabbed sheets which will be used for image formation for a first set among the tabbed sheets constituting the one tabbed sheet group, wherein the control unit is adapted to determine a number of surplus tabbed sheets which will be left unused for the image formation for the first set among the tabbed sheets constituting the one tabbed sheet group in accordance with the determined number of tabbed sheets constituting the one tabbed sheet group and the determined number of the tabbed sheets which will be used for the image formation for the first set, and in a case where the number of the tabbed sheets which will be used for the image formation for the first set is not greater than the determined number of surplus tabbed sheets, the control unit is adapted, at a time of image formation for a second set, to make control such that the rotation processing and the sorting processing are performed by the image processing unit, front and back sides of the surplus tabbed sheets are reversed and the reversed surplus tabbed sheets are fed by the refeeding unit, and images subjected to the rotation processing and the sorting processing are formed on the surplus tabbed sheets by the image processing unit.

According to a second aspect of this invention, there is provided a control method for an image forming apparatus in which tabbed sheets fed from at least one tabbed sheet group are respectively formed with images and the tab sheets formed with the images are output, each of the at least one tabbed sheet group consisting of a plurality of tabbed sheets having tabs formed therein at different positions, the control method comprising a first determination step of determining number of the tabbed sheets constituting one tabbed sheet group and determining number of tabbed sheets which will be used for image formation for a first set among the tabbed sheets constituting the one tabbed sheet group, a second determination step of determining number of surplus tabbed sheets which will be left unused for the image formation for the first set among the tabbed sheets constituting the one tabbed sheet group in accordance with the determined number of tabbed sheets constituting the one tabbed sheet group and the determined number of the tabbed sheets which will be used for the image formation for the first set, and a control step of making, in a case where the number of the tabbed sheets which will be used for the image formation for the first set is not greater than the determined number of surplus tabbed sheets, control such that image information for a second set is performed using the surplus tabbed sheets, wherein the control step includes an image processing step of performing rotation processing to rotate at least one image to be formed on at least one surplus tabbed sheet to a predetermined direction and performing sorting processing to sort the at least one image into a predetermined order, a refeeding step of reversing front and back sides of the at least one surplus tabbed sheet and refeeding the reversed surplus tabbed sheet, and an image forming step of forming the at least one image subjected to the rotation processing and the sorting processing on the at least one surplus tabbed sheet refed in the refeeding step.

This invention makes it possible for surplus tabbed sheets produced in each output to be reutilize for the next set of output, without requiring a user to perform troublesome operations.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
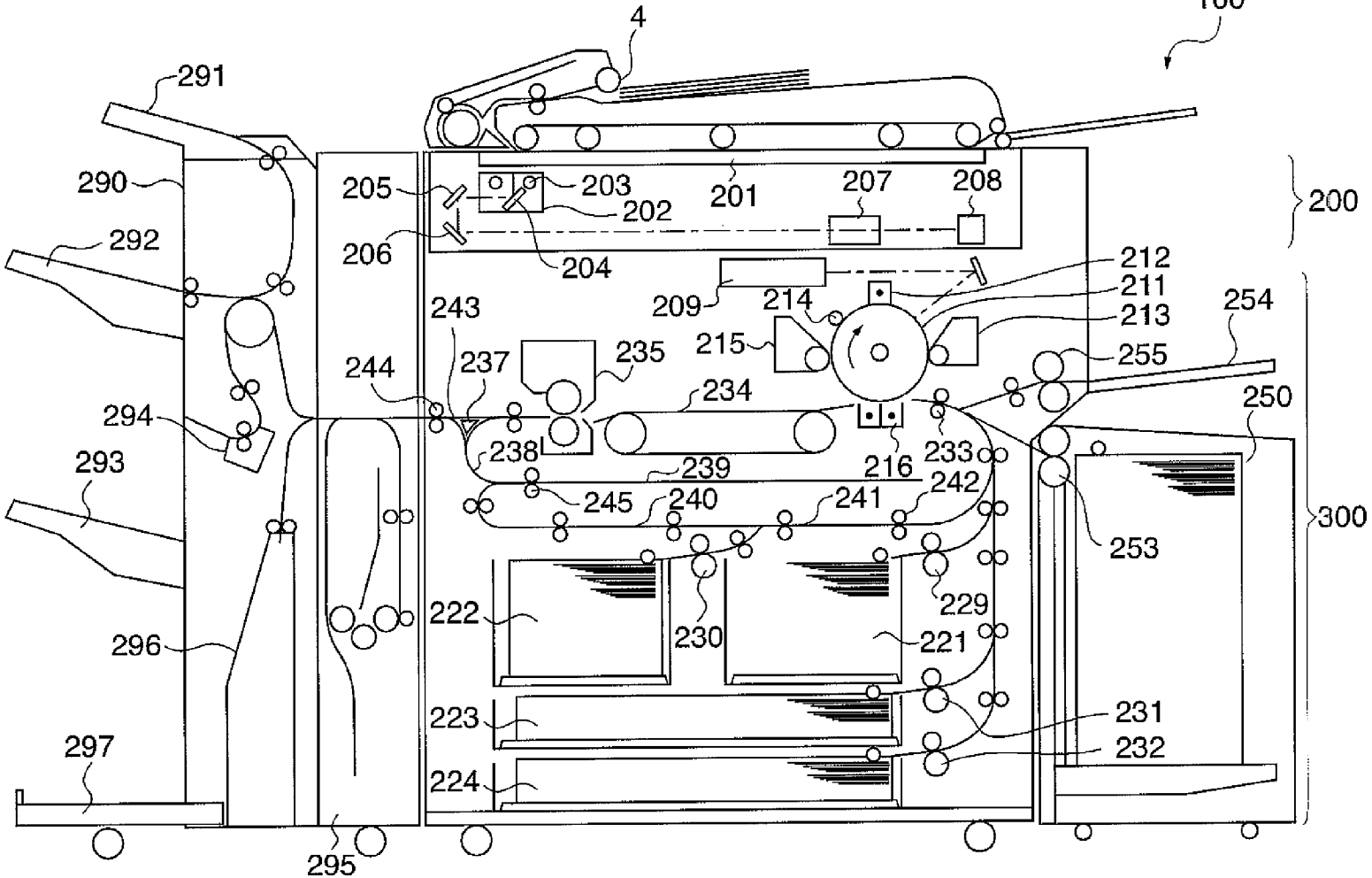
FIG. 1 is a longitudinal section view showing the construction of an image forming apparatus according to one embodiment of this invention.

FIG. 1 shows in longitudinal section the construction of an image forming apparatus according to one embodiment of this invention. In this embodiment, a description will be given of an electrophotographic digital copying machine as the image forming apparatus.

As shown in FIG. 1, the image forming apparatus 100 includes a reader unit 200 for reading an image of an original, and a printer unit 300 for forming an image on a sheet. The reader unit 200 has an automatic original feeder 4 mounted thereon for feeding an original onto a platen glass 201. The reader unit 200 includes a movable table 202 on which an original illuminating lamp 203 and a scanning mirror 204 are installed. At the time of original-through reading, the movable table 202 is kept stopped at a reading position and an original conveyed along the platen glass 201 is read. At the reading position, the original is illuminated by the original illuminating lamp 203. On the other hand, at the time of stationary original reading, the movable table 202 is moved in a sub-scanning direction relative to an original placed on the platen glass 201, with the original illuminated by the original illuminating lamp 203.

At the time of original-through reading or stationary original reading, reflection light from the original illuminated by the original illuminating lamp 203 is introduced into a CCD 208 via scanning mirrors 204-206 and a lens 207, and an optical image is formed on an image pickup surface of the CCD 208. In the CCD 208, the optical image is photoelectrically converted into electrical signals for output. The electrical signals are converted into digital signals and stored as image data into an image memory (not shown). The image data stored in the image memory is read out in predetermined timing and transferred to the printer unit 300.

The printer unit 300 includes an exposure controller 209 for modulating a laser beam in accordance with the image data and outputting the modulated laser beam. The laser beam output from the exposure controller 209 is irradiated toward the photosensitive drum 211.

Around the photosensitive drum 211, there are disposed a primary charger 212, a developing device 213, a transfer device 216, a preexposure lamp 214, and a cleaner 215. The photosensitive drum 211 is rotated in a direction shown by an arrow in FIG. 1, and is charged at its surface to predetermined electric potential by the primary charger 212. The laser beam is irradiated onto the photosensitive drum 211, whereby an electrostatic latent image is formed thereon.

The electrostatic latent image formed on the photosensitive drum 211 is visualized into a toner image by toner supplied from the developing device 213.

The toner image is transferred by the transfer device 216 onto a sheet fed from a sheet feed stage, which is either one of sheet feeding cassettes 221-224, a manual feed tray 254, and a sheet feed deck 250. Each of the sheet feed stages 221-224, 254, and 250 is loaded with sheets of desired size. Sheets loaded on each of the sheet feed stages 221-224, 254, and 250 are fed one-by-one by means of corresponding ones of sheet feed rollers 229-232, 255, and 253. A sheet fed from either one of the sheet feed stages is conveyed by registration rollers 233 in predetermined timing to between the photosensitive drum 211 and the transfer device 216, and a toner image formed on the photosensitive drum 211 is transferred onto the sheet by the transfer device 216.

The sheet onto which the toner is transferred is conveyed by a conveyance belt 234 to a fixing device 235. After completion of transfer of the toner image and for preparation of the next image formation, toner remaining on the photosensitive drum 211 is removed by the cleaner 215. Any residual electric charge remaining on the photosensitive drum 211 is removed by the preexposure lamp 214.

The fixing device 235 receives the sheet and heats and pressurizes the same, whereby the toner on the sheet is fixed thereto. The sheet passing through the fixing device 235 is conveyed toward a flapper 237 and further conveyed by the flapper 237 toward a conveyance path 238 or a discharge path 243.

To convey the sheet to the conveyance path 238 by the flapper 237, a double-sided mode for image formation on both sides of the sheet is set. In the double-sided mode, the sheet conveyed to the conveyance path 238 is conveyed by inversion rollers 245 to an inversion path 239 and then conveyed from the inversion path 239 to a lower conveyance path 240 by reversely rotating the inversion rollers 245. Subsequently, the sheet is introduced into a refeed path 241 via the lower conveyance path 240. The sheet introduced into the refeed path 241 is conveyed by refeed rollers 242 toward the registration rollers 233.

On the other hand, the sheet conveyed toward the discharge path 243 is conveyed to a sheet processing unit 290 by sheet discharge rollers 244. The sheet may be reversed and then conveyed to the sheet processing unit 290. In that case, the sheet is introduced by the flapper 237 into the conveyance path 238, and is pulled by the inversion rollers 245 into the inversion path 239 to an extent that a rear end portion of the sheet is positioned short of the inversion path 239. By rotating the inversion rollers 245 reversely, the sheet is conveyed again via the conveyance path 238 to the sheet discharge rollers 244. At this time, the sheet is conveyed in a reversed state to the sheet discharge rollers 244. Then, the sheet is conveyed by the sheet discharge rollers 244 to the sheet processing unit 290.

The sheet processing unit 290 includes a Z folding unit 295 for Z-folding a sheet, an inserter 291 for inserting an insert sheet between discharged sheets, and a book-binding processing unit 296 for collecting discharged sheets in a bundle and for center-folding the sheet bundle. The sheet bundle is bound for book-binding by a stapler. The book-bound sheet bundle is discharged toward a sheet discharge tray 297. The book-binding processing unit 296 is able to discharge sheets toward the sheet discharge tray 297, without book-binding the sheets.

The sheet processing unit 290 is able to convey discharged sheets one-by-one toward a processing tray 294, whereby the sheets are stacked in a bundle on the processing tray 294. The sheet bundle stacked on the processing tray 294 are bound by the stapler and discharged toward the sheet discharge tray 292 or 293. The sheet discharge trays 292, 293 are configured to be movable upward and downward as desired. By moving the sheet discharge trays 292, 293 upward and downward, sheets can be sorted.

The sheet processing unit 290 is able to selectively discharge sheets to any of the sheet discharge trays 292, 293 and 297, without performing the sheet processing on the sheets.

Figure 2:
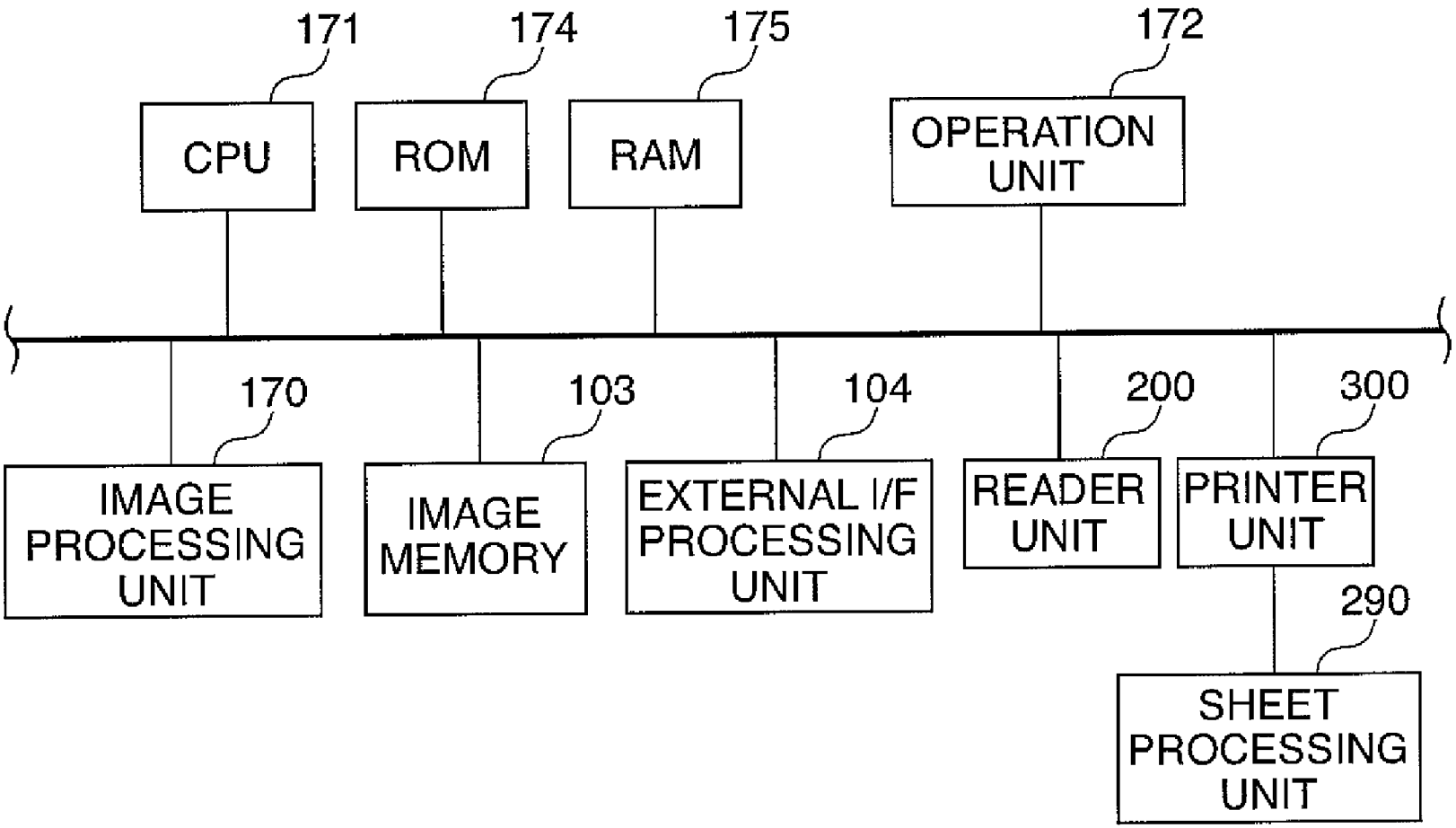
FIG. 2 is a block diagram showing the control construction of the image forming apparatus in FIG. 1.

Next, a description will be given of the control construction of the image forming apparatus 100 with reference to FIG. 2. FIG. 2 shows in block diagram the control construction of the image forming apparatus 100 in FIG. 1.

As shown in FIG. 2, the image forming apparatus 100 includes a CPU 171 to which are connected a ROM 174, a RAM 175, an operation unit 172, an image memory 103, an image processing unit 170, an external I/F processing unit 104, the reader unit 200, and the printer unit 300. In accordance with a program stored in the ROM 174, the CPU 171 controls the respective blocks 172, 103, 170, 104, 200, and 300. A work area for the CPU 171 is provided by the RAM 175. The CPU 171 also controls the sheet processing unit 290 via the printer unit 300.

The operation unit 172 includes a plurality of keys used for making settings of various operation modes such as a copy mode, a print mode, and a facsimile mode and also used for making settings of detailed information on the operation modes. The operation unit 172 further includes a liquid crystal display panel for displaying various information indicating the state of the apparatus, the contents of a set operation mode, etc. The liquid crystal display panel is able to display soft keys used for inputting various setting information. Setting information input by a user via the operation unit 172 is sent to the CPU 171. Information displayed on the operation unit 172 are generated by the CPU 171.

The image memory 103 stores therein image data read from an original by the reader unit 200 and image data input via the external I/F processing unit 104 from an external apparatus. The image memory 103 also stores image data subjected to predetermined processing by the image processing unit 170 as described below.

The image processing unit 170 performs predetermined processing, where required, on image data stored in the image memory 103. For example, the image processing unit 170 performs compression and decompression processing on the image data. The image processing unit 170 performs sorting plural pieces of image data stored in the image memory 103 into a desired order to thereby realize sorting, which is alternative to sorting to change a sheet discharge tray which is a destination of discharged sheets. The image processing unit 170 also performs processing to magnify or reduce an image. Further, the image processing unit 170 is able to carry out image extraction processing to extract a part of image data, image rotation processing to rotate image data to a desired angle, image shift processing to shift image data toward a predetermined direction, etc.

Image data processed by the image processing unit 170 is temporarily stored in the image memory 103 and then delivered to the printer unit 300 or the external I/F processing unit 104.

The external I/F processing unit 104 performs data transmission/reception to and from a personal computer, etc. The external I/F processing unit 104 also performs data transmission/reception to and from a facsimile apparatus through facsimile communication via a telephone line.

As described above, the reader unit 200 reads an image of an original and outputs image data. As described above, the printer unit 300 performs image formation on a sheet based on the image data. Sheets output from the printer unit 300 are conveyed to the sheet processing unit 290 that performs predetermined sheet processing on the sheets.

Figure 3:
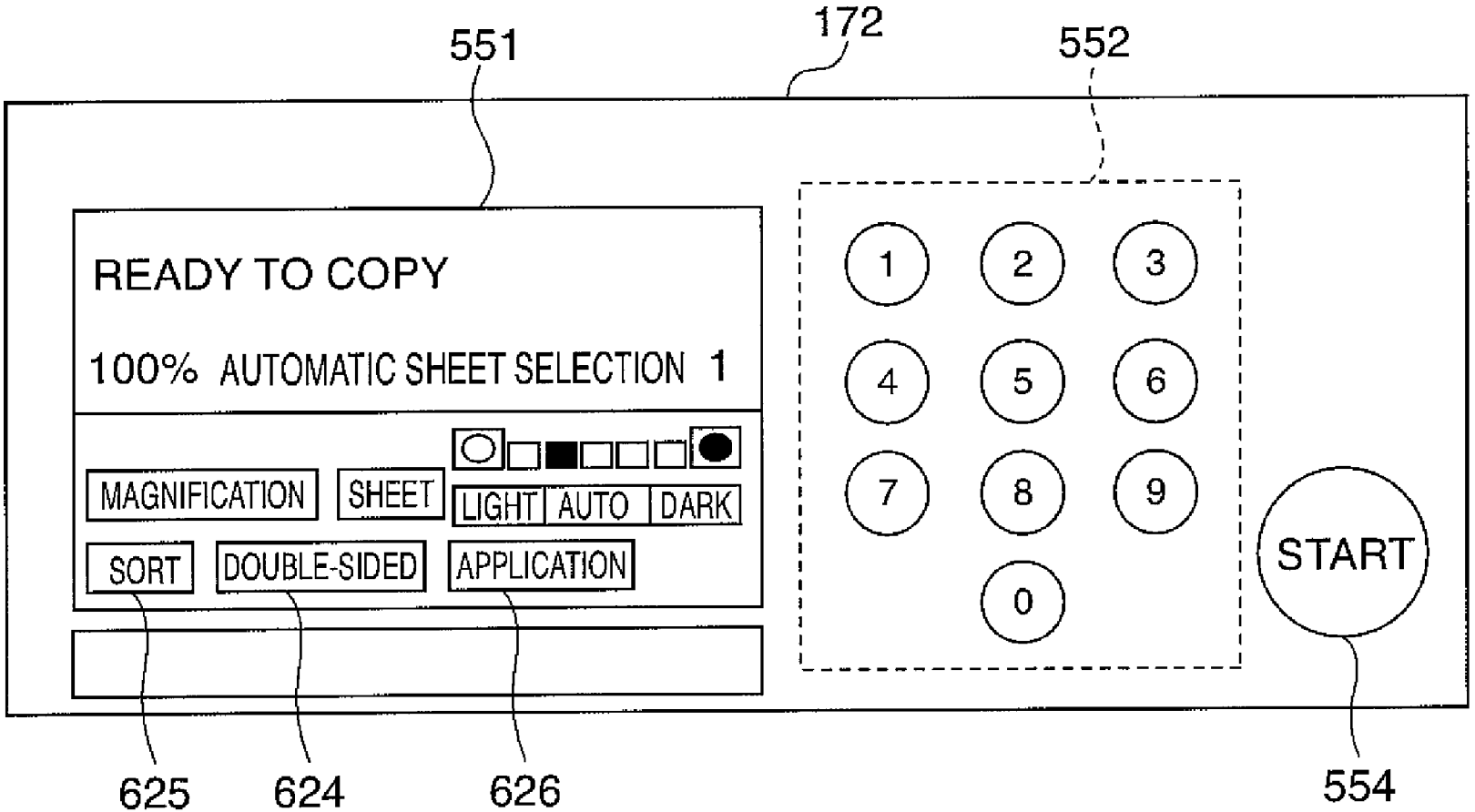
FIG. 3 is a plan view showing an operation unit in FIG. 2.

Next, the details of the operation unit 172 will be described with reference to FIG. 3. FIG. 3 shows in plan view the operation unit 172 in FIG. 2.

As shown in FIG. 3, the operation unit 172 includes a plurality of hard keys, including a numeric keypad 522 used for inputting numerical values and a start key 554 used for giving an operation start instruction, and a liquid crystal display panel 551 for displaying operation screens for various settings. In FIG. 3, an initial operation screen is displayed on the liquid crystal display panel 551. In the initial operation screen, a plurality of soft keys including a double-sided key 624, a sort keys 625, and an application key 626 are displayed along with information indicating the content of settings, a current operation state, etc.

Figure 4A:
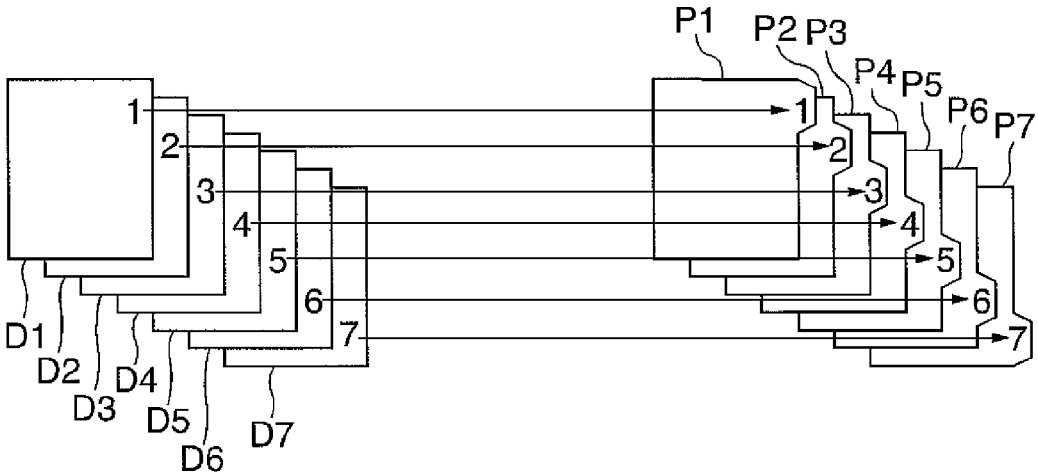
FIGS. 4A and 4B are views schematically showing a positional relation between tab images contained in originals and tab images formed on tabbed sheets.
Figure 4B:
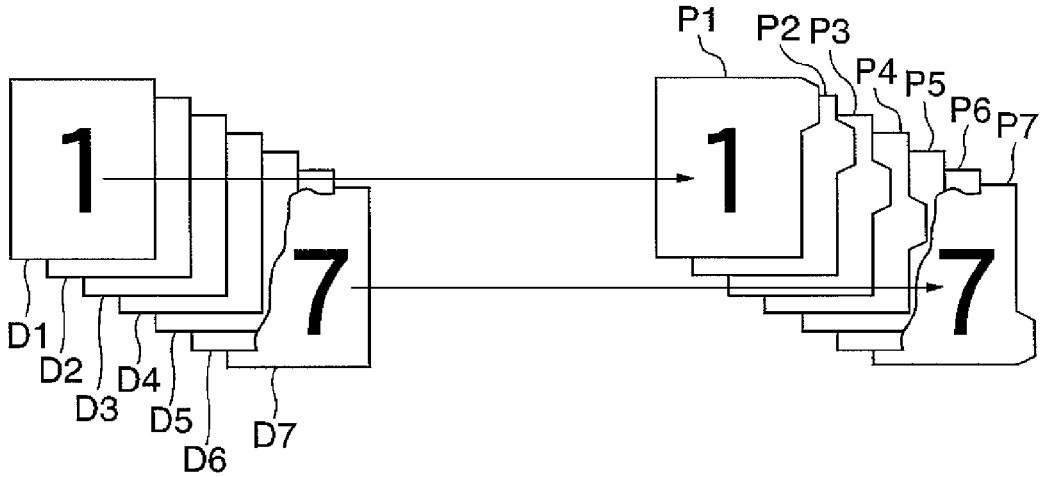
Figure 5:
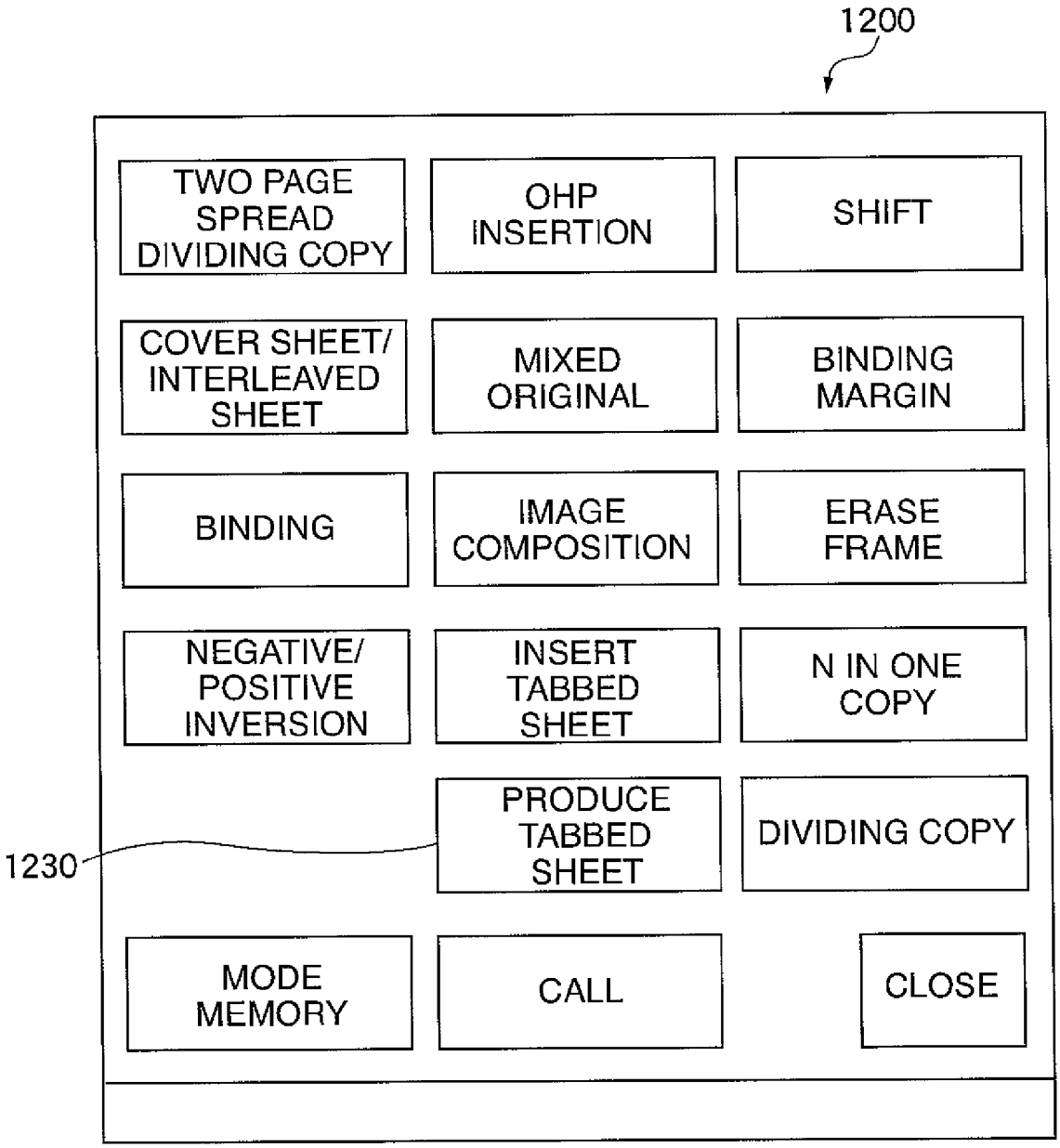
FIG. 5 is a view showing an example of an operation screen displayed when an application key is depressed on an initial operation screen in FIG. 3.
Figure 6:
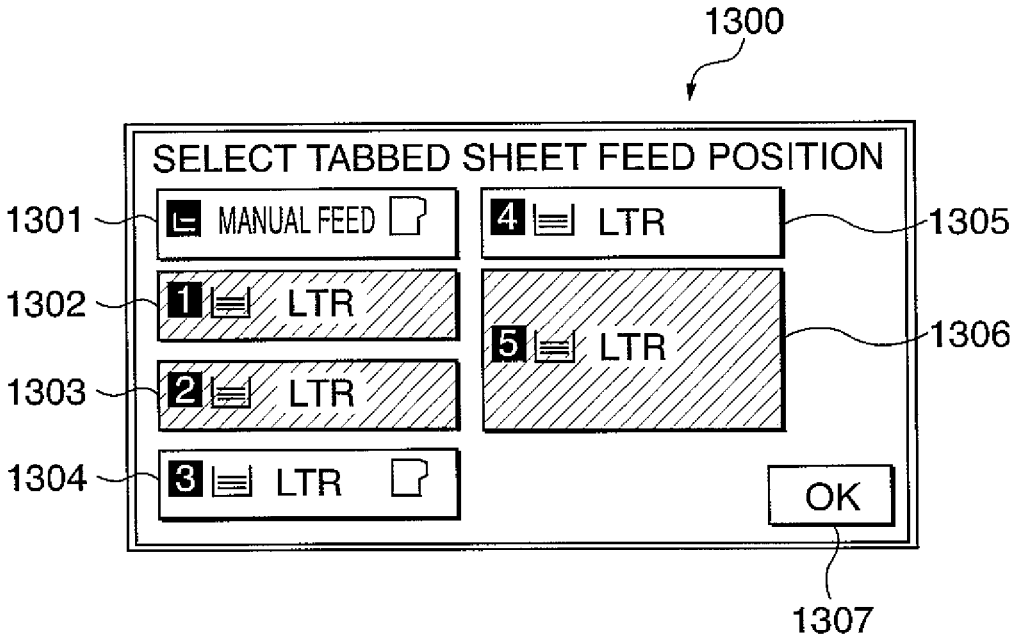
FIG. 6 is a view showing an example of an operation screen for use in selecting a sheet feed stage from which tabbed sheets are fed.
Figure 7:
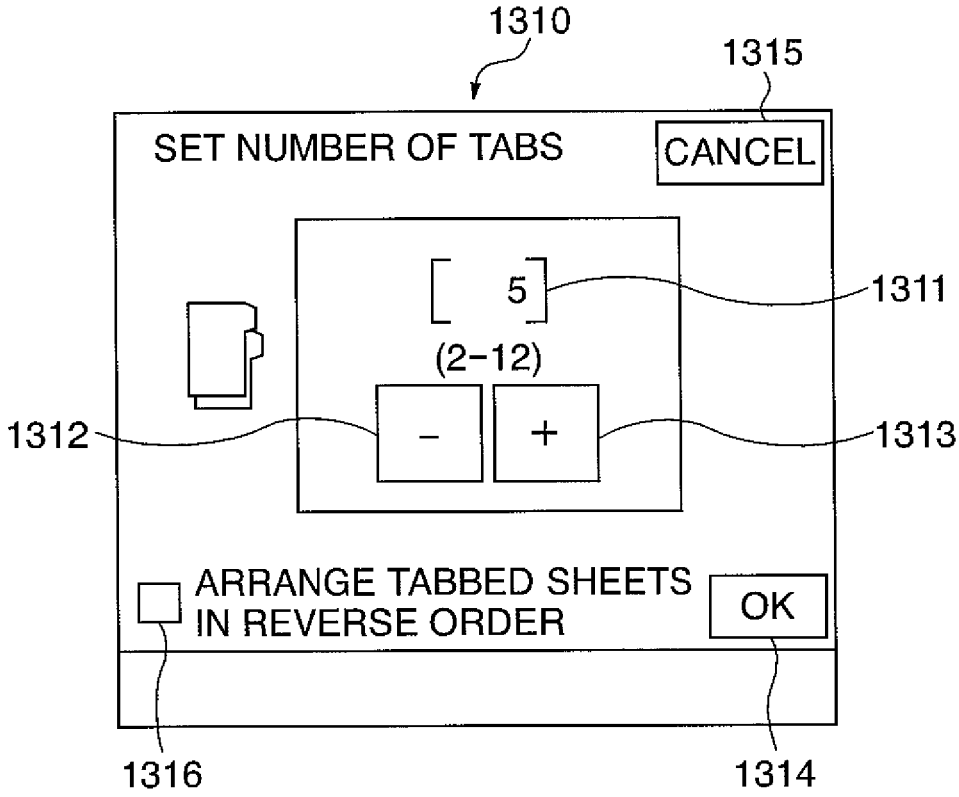
FIG. 7 is a view showing an example of an operation screen for use in setting the number of tabs.
Figure 8:
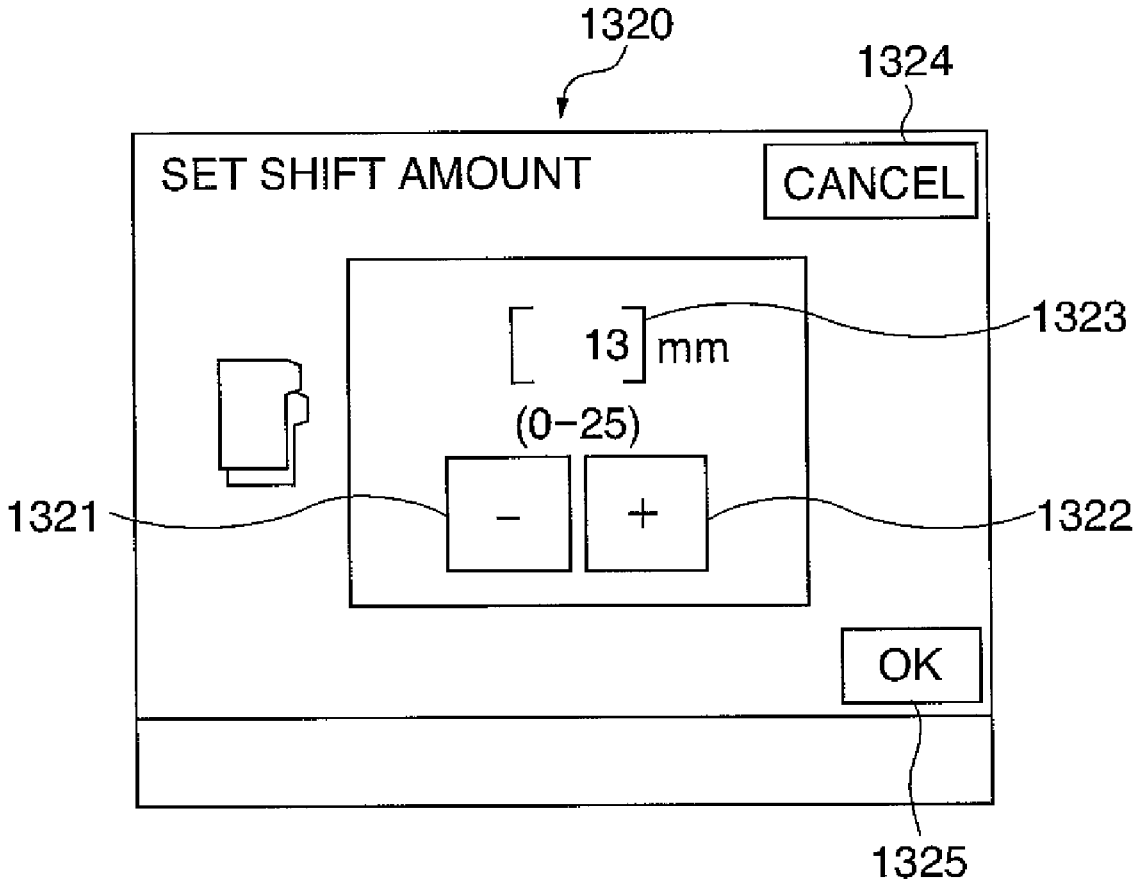
FIG. 8 is a view showing an operation screen for use in setting an amount of shift of a tab image, which is used for formation of a tab image contained in an original on a tabbed sheet.
Figure 9B:
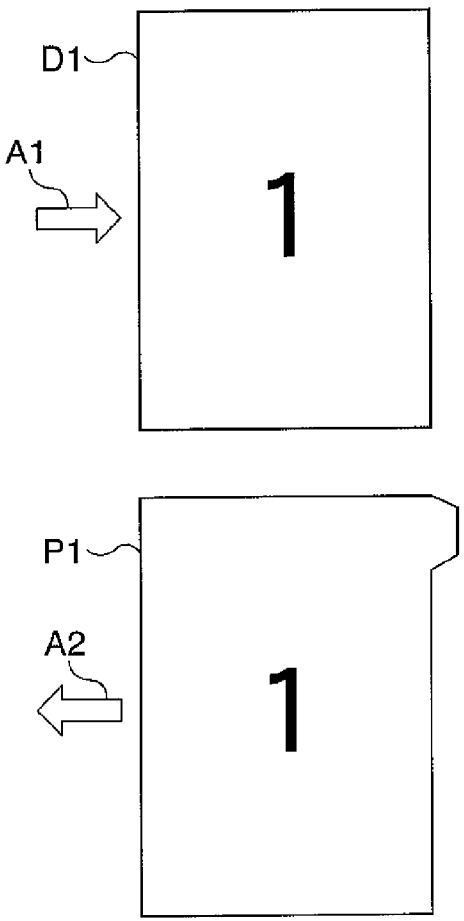
FIGS. 9A and 9B are views schematically showing an amount of shift of a tab image contained in an original relative to a tabbed sheet.
Figure 9A:
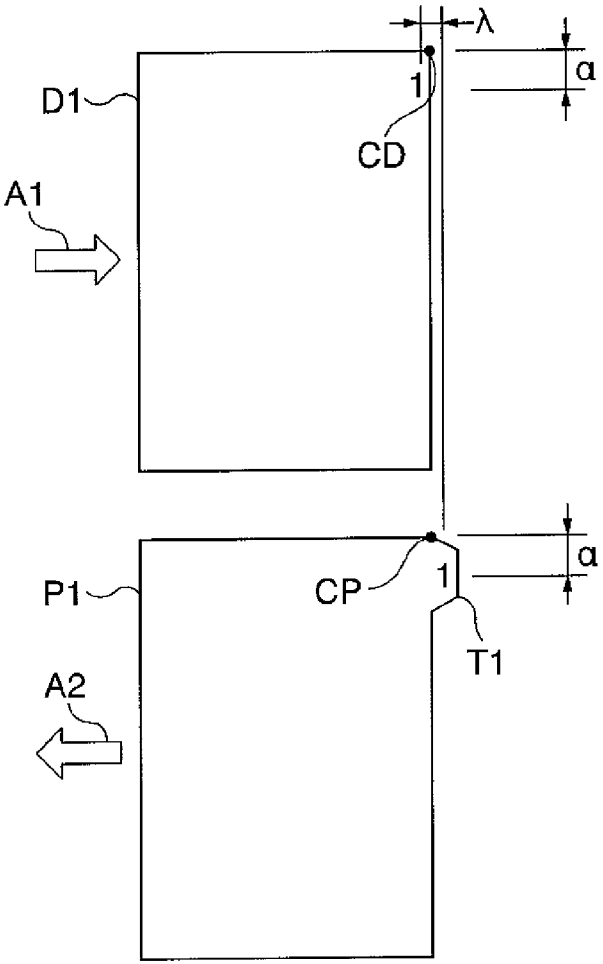

In this embodiment, there is provided a tabbed sheet creation mode, in which images to be formed on tabbed sheets (hereinafter referred to as the tab images) are read from originals and the read tab images are formed on the tabbed sheets. With reference to FIGS. 4A to 9B, the tabbed sheet creation mode will be described. FIGS. 4A and 4B schematically show a positional relation between tab images contained in originals and tab images formed on tabbed sheets. FIG. 5 shows an example of an operation screen displayed when the application key is depressed on the initial operation screen in FIG. 3. FIG. 6 shows an example of an operation screen used for selecting a sheet feed stage from which tabbed sheets are fed. FIG. 7 shows an example of an operation screen used for setting the number of tabs. FIG. 8 shows an operation screen for setting an amount of shift of tab image for use when a tab image contained in an original is formed on a tabbed sheet. FIGS. 9A and 9B schematically show an amount of shift of a tab image contained in an original relative to a tabbed sheet.

Respective tab images can be made to correspond in position to tabs and sheet bodies of tabbed sheets. Each tab image includes a first tab image to be formed on the tab of a corresponding tabbed sheet and a second tab image to be formed on the sheet body of the tabbed sheet (which is a major part of the tabbed sheet other than the tab). Originals each containing a tab image are the same in size as the sheet bodies of tabbed sheets.

For example, as shown in FIG. 4A, seven originals D1-D7 are prepared for image formation on seven tabbed sheets P1-P7 having tabs thereof which are different in position. The originals D1-D7 respectively contain first tab images to be formed on the tabbed sheets P1-P7. The first tab images are read from the originals D1-D7, and the read first tab images are respectively formed on the tabs of the tabbed sheets P1-P7. The first tab images "1" to "7" shown in FIG. 4A are made to correspond in position to the tabs of the tabbed sheets P1-P7.

For formation of second tab images on respective ones of the sheet bodies of the seven tabbed sheets P1-P7 as shown in FIG. 4B, seven originals D1-D7 are prepared. These originals D1-D7 respectively contain the second tab images to be formed on the sheet bodies of the tabbed sheets P1-P7. The second tab images are read from the originals D1-D7, and the read second tab images are formed on the sheet bodies of the tabbed sheets P1-P7.

To set the tabbed sheet creation mode, the application mode key 626 is depressed on the initial operation screen, whereby an operation screen 1200 shown for example in FIG. 5 is displayed. On the operation screen 1200, there are displayed mode selection keys respectively corresponding to a plurality of application modes. To select the tabbed sheet creation mode which is one of the application modes, a tabbed sheet creation key 1230 is depressed.

When the tabbed sheet creation key 1230 is depressed on the operation screen 1200, an operation screen 1300 shown in FIG. 6 is displayed on the liquid crystal display panel 551. The operation screen 1300 is used to select a desired one of the manual feed tray 254, the sheet feeding cassettes 221-224, and the sheet feed deck 250, as a sheet feed stage from which tabbed sheets are fed. On the operation screen 1300, there are displayed keys 1301-1306 respectively corresponding to the manual feed tray 254, the sheet feeding cassettes 221-224, and the sheet feed deck 250. Since candidates for the sheet feed stage are limited in this example to the manual feed tray 254, the sheet feeding cassettes 223, 224 and the sheet feed deck 250, there are displayed for selection only the corresponding keys 1301, 1304 and 1305, with the other unselectable keys 1302, 1303 and 1306 displayed in shaded display. When, for example, the key 1301 is depressed, the manual feed tray 254 is selected as the sheet feed stage for feeding the tabbed sheets. It should be noted that a group of tabbed sheets P1-P7 are loaded on a desired one of the manual feed tray 254, the sheet feeding cassettes 223, 224, and the sheet feed deck 250 such that the tab-formed side of each tabbed sheet extends perpendicular to the direction of conveyance of the tabbed sheets.

After the sheet feed stage is selected, an OK key 1307 is depressed to fixedly determine the selected sheet feed stage.

Upon completion of selection of the sheet feed stage for the tabbed sheets, an operation screen 1310 shown for example in FIG. 7 is displayed on the liquid crystal display panel 551. On the operation screen 1310, there is performed setting of the number of tabs, i.e., the number of tabbed sheets constituting the tabbed sheet group loaded in the selected sheet feed stage.

Specifically, a value representing the number of tabs is input into a region 1311 by operating a minus key 1312 and a plus key 1313. In this example, a tabbed sheet group consisting of from two tabbed sheets to twelve tabbed sheets can be handled, and a value of 5 is set as the number of tabs. In that case, one or more tabbed sheet groups each consisting of five tabbed sheets are loaded on the selected sheet feed stage. A check box 1316 is checked, if the tabbed sheets are arranged in a reverse order in each tabbed sheet group loaded on the sheet feed stage.

Upon completion of the setting of the number of tabs and the order of arrangement of tabbed sheets, an OK key 1314 is depressed, whereby the contents of setting are finalized.

To cancel the contents thus set, a cancel key 1315 is depressed, resulting in a shift from the operation screen 1310 to the previous operation screen 1300.

It should be noted that the number of tabs may not be set upon selection of the tabbed sheet creation mode, but may be set when tabbed sheets are loaded onto a sheet feed stage.

At completion of the setting of the number of tabs, an operation screen 1320 shown for example in FIG. 8 is displayed on the liquid crystal display panel 551. The operation screen 1320 is used for setting an amount of shift of first tab images.

Next, a description will be given of how the amount of shift of first tab images is set in an example that first tab images are formed on the respective tabs of seven tabbed sheets P1-P7 in FIG. 4A. In this example, as shown in FIG. 9A, the first tab image "1" of the original D1 is at the same longitudinal position in the original D1 as that of the tab in the tabbed sheet P1. Specifically, if the tab T1 of the tabbed sheet P1 is at a longitudinal position at a distance of a from an upper edge CP, the first tab image "1" of the original D1 is at a longitudinal position at a distance of a from an upper edge CD. The first tab image "1" has a size smaller than that of the tab of the tabbed sheet P1.

The original D1 containing the first tab image "1" is read in the width direction thereof (i.e., in the direction shown by arrow A1 in FIGS. 9A and 9B). On the other hand, the tabbed sheet P1 is fed, with the tab positioned backward in the conveyance direction (i.e., in the direction shown by arrow A2 in FIGS. 9A and 9B). To form the first tab image "1" read from the original D1 exactly at the widthwise position of the tab on the tabbed sheet P1, it is necessary to shift the first tab image "1" by a shift amount λ in the widthwise direction of the tabbed sheet. The shift amount λ, which should be applied in the direction of conveyance of the tabbed sheet P1 (i.e., in the direction shown by arrow A2 in FIGS. 9A and 9B), is set on the operation screen 1320.

The shift amount λ, which is set for formation of the first tab image on the tab of the tabbed sheet concerned, can be set to a value in a range of, for example, 0 mm to 25 mm. The shift amount λ is set on the operation screen 1320 by operating a minus key 1321 to decrease the shift amount λ input to a region 1323 and a plus key 1322 to increase the shift amount λ input to the region 1323. In the region 1323, a value of 0 mm is usually input as an initial value of the shift amount λ.

To fixedly determine the shift amount λ input to the region 1323, an OK key 1325 is depressed. When a cancel key 1324 is depressed, the setting of the shift amount λ is canceled, resulting in a shift from the operation screen 1320 to the previous operation screen 1310.

In the case of forming second tab images on respective ones of sheet bodies of seven tabbed sheets P1-P7, which are shown for example in FIG. 4B, it is unnecessary, as shown in FIG. 9B, to shift the second tab image "1" read from the original D1 to the position of the tab of the tabbed sheet P1, and therefore the shift amount λ is set to a value of 0 mm on the operation screen 1320.

In this embodiment, upon formation of tab images on tabbed sheets in the tabbed sheet creation mode, the number of tabbed sheet groups which will be used for one set of image formation is determined. Then, among the tabbed sheets constituting one tabbed sheet group which is one of at least one tabbed sheet group used for image formation, the number of tabbed sheets which will be used for the image formation and the number of surplus tabbed sheets which will be left unused for the image formation are determined.

It is assumed here that the total number of tabbed sheets which will be used for one set of image formation is T, the number of tabbed sheets constituting one tabbed sheet group is S, and the number of tabbed sheet groups which will be used for one set of image formation is G. The number of tabbed sheets constituting one tabbed sheet group, S, is set by the user on the operation screen 1310. Based on these values, the number of one or more tabbed sheets, A, which will be used for the image formation among the tabbed sheets constituting the G-th tabbed sheet group is determined. The number of surplus tabbed sheets, B, in the G-th tabbed sheet group, which will be left unused for the image formation, is also calculated. The total number of sheets used for image formation, T, the number of the sheets constituting each group, S, the number of groups, G, the number of sheets in the last group (G-th group) used for image formation, A, and the number of surplus sheets, B, satisfy the following relational expression.

$$A=T-(G-1)\times S \tag{1}$$

$$B=S-A \tag{2}$$

As for the B surplus tabbed sheets which will be produced in one set of image formation, it is determined what tabbed sheet number the surplus tabbed sheets (unused tabbed sheets) begin with in the one tabbed sheet group including the surplus tabbed sheets.

If the determined number of surplus tabbed sheets, B, is equal to 0, there will be produced no surplus tabbed sheets, and therefore all the tabbed sheets constituting the G-th tabbed sheet group will be used. In other words, all the tabbed sheets constituting the G tabbed sheet groups will be used for one set of image formation.

If, on the other hand, the number of surplus tabbed sheets, B, is not equal to 0, i.e., if equal to or larger than 1, it is determined whether or not the relation of A=B (i.e., A is equal to or less than B) is fulfilled between the number of tabbed sheets in the G-th group which will be used for one set of image formation, A, and the number of surplus tabbed sheets, B.

If the relation of A=B is not fulfilled, the B surplus tabbed sheets do not include surplus tabbed sheets that can be reutilized for the next set of image formation. Thus, only one set of image formation is performed, without using the surplus tabbed sheets. Then, the surplus tabbed sheets are discharged.

If the relation of A=B is fulfilled, the B surplus tabbed sheets include surplus tabbed sheets that can be reutilized for the next set (the second set) of image formation. Therefore, the second set of image formation will be carried out using the tabbed sheet group including the surplus tabbed sheets. In this case, among the surplus tabbed sheets which will be produced in the first set of image formation, one or more surplus tabbed sheets (second surplus tabbed sheets) which will be produced in the second set of image formation are determined. Then, the first set of output is performed. After completion of the first set of image formation, the identified one or more surplus tabbed sheets in the second set are discharged.

Next, the rotation processing and the sorting processing are performed on the tab images concerned, and refeed processing is carried out for the tabbed sheets including the surplus tabbed sheets in the first set (but not including the surplus tabbed sheets in the second set). Subsequently, the tab images (subjected to the rotation processing and the sorting processing) are formed on respective ones of the refed tabbed sheets, and these tabbed sheets are discharged. In this manner, the second set of image formation is carried out.

Figure 10:
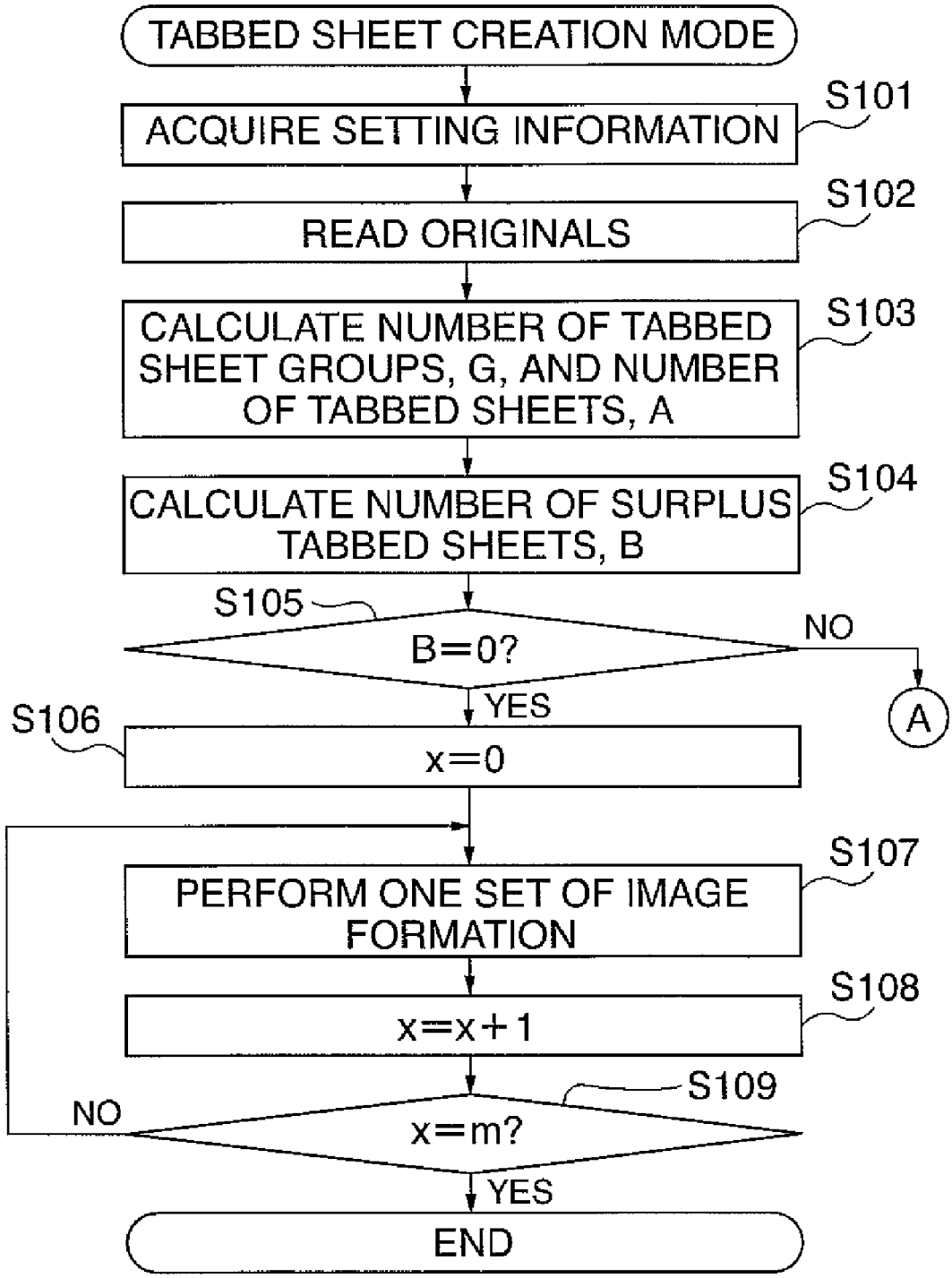
FIG. 10 is a flowchart showing a part of the procedures in a tabbed sheet creation mode.
Figure 11:
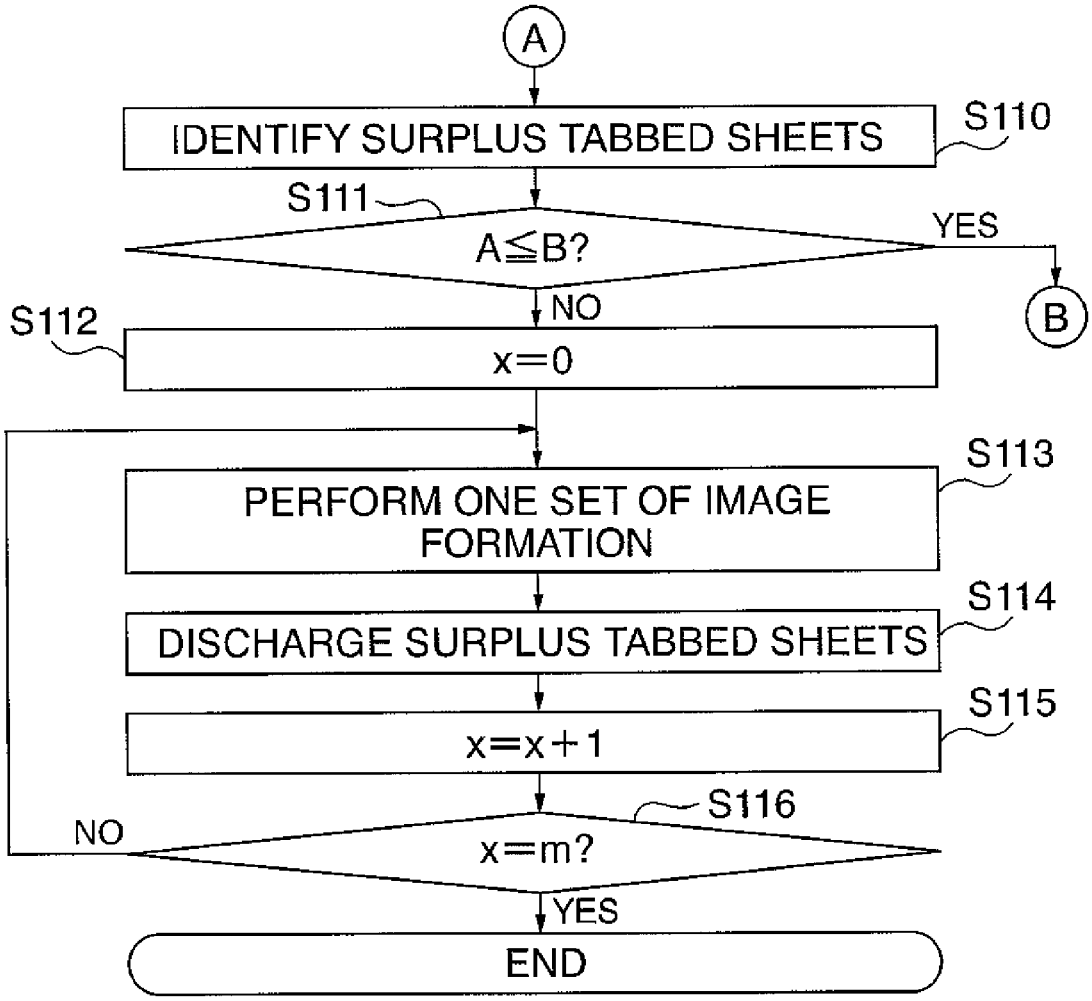
FIG. 11 is a flowchart showing another part of the procedures in the tabbed sheet creation mode.
Figure 12:
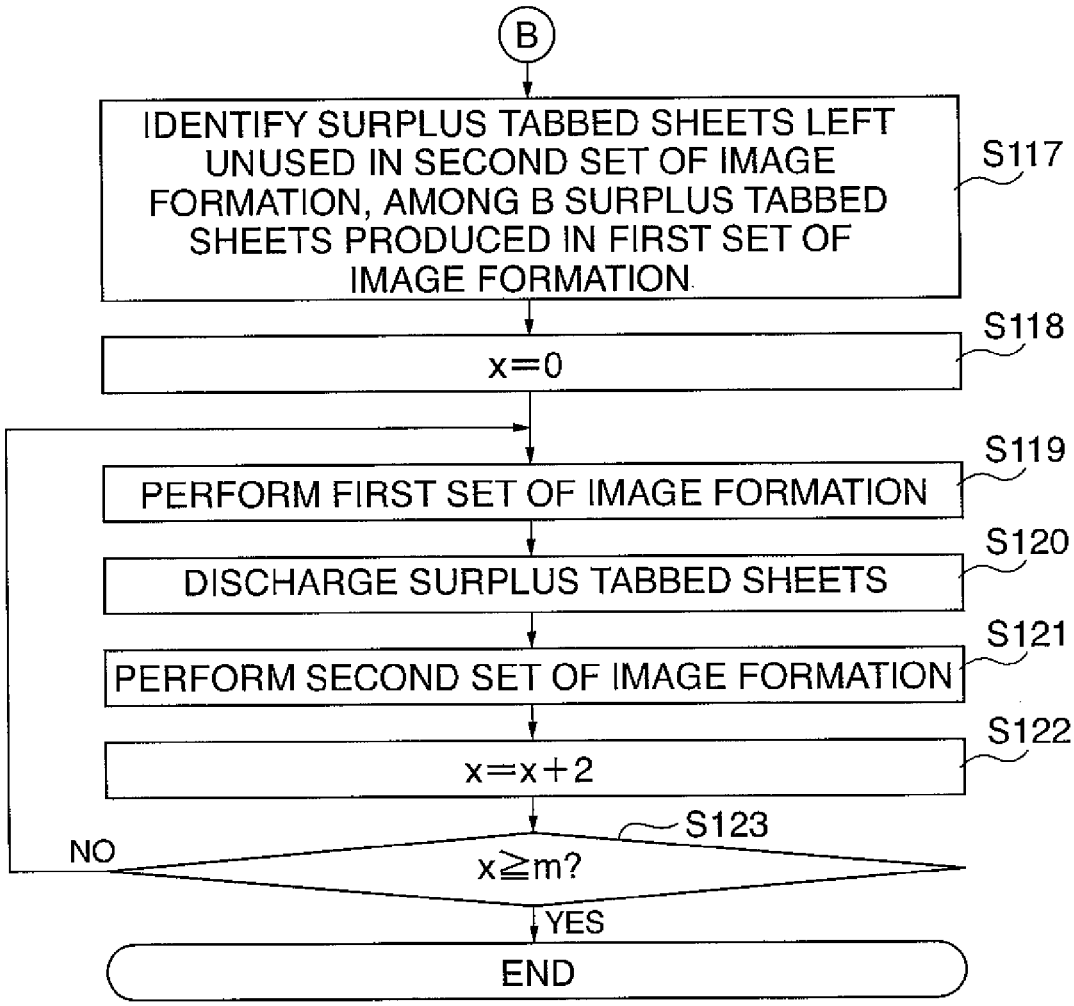
FIG. 12 is a flowchart showing the remaining part of the procedure in the tabbed sheet creation mode.

With reference to FIGS. 10-12, the procedures in the tabbed sheet creation mode will be described. FIGS. 10-12 show in flowchart the procedures in the tabbed sheet creation mode. The procedures in flowcharts of FIGS. 10-12 are implemented by the CPU 171 in accordance with a program stored in the ROM 174.

When executing the tabbed sheet creation mode, the CPU 171 first acquires pieces of setting information on the tabbed sheet creation mode, which are input by the user (step S101 in FIG. 10). In this embodiment, information on the number of sets of output, m, and the sheet feed stage selected for tabbed sheets (operation screen 1300) are acquired. Information on the number of tabs, i.e., the number of tabbed sheets, S, constituting one tabbed sheet group, the sorting order of tabbed sheets (operation screen 1310), and the set shift amount λ (operation screen 1320) are also acquired.

Next, the CPU 171 controls the reader unit 200 to sequentially read plural sheets of originals (step S102). The plural sheets of originals, which are prepared in advance by the user, respectively include tab images that can be made to correspond to positions of respective tabs of tabbed sheets. The tab images read from the originals are stored into the image memory 103. Then, the CPU 171 calculates the number of tabbed sheet groups, G, which will be used for one set of image formation, and the number of tabbed sheets, A, which will be used for the one set of image formation among the tabbed sheets constituting the G-th tabbed sheet group (step S103). Here, the number of sheets which is equal to the number of the read tab images (the number of sheets of originals) is calculated as the total number of tabbed sheets, T, which will be used for the one set of image formation. Then, in accordance with expression (1), the number of tabbed sheets, A, is calculated.

Next, in accordance with expression (2), the CPU 171 calculates the number of surplus tabbed sheets, B (step S104). Then, the CPU 171 determines whether or not the calculated number of surplus tabbed sheets, B, is equal to 0 (step S105). If it is determined that the number of sheets, B, is equal to 0, no surplus tabbed sheets will be produced, and therefore all the tabbed sheets constituting the G-th tabbed sheet group will be used. That is, all the tabbed sheets constituting the G tabbed sheet groups will be used for one set of output consisting of tabbed sheets which are T in total number.

In this case, the CPU 171 first initializes the number of sets of output, x, to 0 (step S106). Then, the CPU 171 controls the printer unit 300 such that one set of image formation is performed, i.e., tab images respectively corresponding to the tabbed sheets which are T in total number are formed on respective ones of the tabbed sheets (step S107).

To this end, the tab images are each shifted by the image processing unit 170 by the acquired shift amount λ, and the shifted tab images are delivered to the printer unit 300. In the printer unit 300, tabbed sheets are fed from one or more tabbed sheet groups which are loaded in the selected sheet feed stage, and tab images corresponding to the fed tabbed sheets are formed on the respective sheets.

The tabbed sheets formed with the tab images are sequentially introduced by the flapper 237 toward the conveyance path 238 and introduced by the inversion rollers 245 into the inversion path 239 and stopped therein. Then, the inversion rollers 245 are reversely rotated, whereby each of the tabbed sheets is conveyed via the conveyance path 238 toward the discharge rollers 244. As a result, each tabbed sheet is reversed from front to back and conveyed toward the discharge rollers 244, with its tab directed forward as viewed in the conveyance direction. Next, the tabbed sheet is conveyed by the discharge rollers 244 to the sheet processing unit 290.

The sheet processing unit 290 operates to discharge each of the tabbed sheets to one of the sheet discharge trays 291 and 293, e.g., the sheet discharge tray 293, without performing the sheet processing thereon.

As described above, the tabbed sheets which are T in total number are respectively fed, tab images are formed on respective ones of these tabbed sheets, and the tabbed sheets are discharged, whereby one set of image formation is carried out. The tabbed sheets are discharged onto the sheet discharge tray 293, with the image formation surfaces thereof directed downward and with the tabs positioned forward in the conveyance direction. That is, the tabbed sheets which are T in total number and which are respectively formed with the tab images are stacked onto the sheet discharge tray 293 in the order from the tabbed sheet corresponding to the first page.

As described above, in this embodiment, the tabbed sheets are stacked in a page order. Alternatively, the tabbed sheets may simply be discharged in sequence without being reversed from front to back.

Next, the CPU 171 increments the number of sets of output, x, by 1 (step S108), and determines whether or not the number of sets of output, x, is equal to the set number of sets of output, m (step S109). If it is determined that the number of sets of output, x, is not equal to the set number of sets of output, m, the CPU 171 returns to step S107 in which it performs control such that the next set of output is carried out. On the other hand, if it is determined that the number of sets of output, x, is equal to the set number of sets of output, m, the CPU 171 completes the present process.

If it is determined at step S105 that the number of surplus tabbed sheets, B, is not equal to 0, the CPU 171 determines the number of surplus tabbed sheets (step S110 in FIG. 11), and compares the number of surplus tabbed sheets, B, with the number of tabbed sheets, A, to thereby determine whether or not the relation of A=B is fulfilled (step S111). If it is determined that the relation of A=B is not fulfilled, only one set of image formation is carried out without using the surplus tabbed sheets.

In this case, the CPU 171 first initializes the number of sets of output, x, to 0 (step S112), and controls the printer unit 300 to perform one set of image formation (step S113). For the image formation, tab images are each shifted by the image processing unit 170 by the shift amount λ and delivered to the printer unit 300. In the printer unit 300, tabbed sheets are fed from one or more tabbed sheet groups which are loaded in the selected sheet feed stage, and the tab images are formed on respective ones of the fed tabbed sheets. As described above, the tabbed sheets formed with the tab images and reversed from front to back are each conveyed to the sheet processing unit 290, which operates to discharge the tabbed sheets onto, e.g., the sheet discharge tray 293, without performing the sheet processing on the tabbed sheets.

Next, the CPU 171 controls the printer unit 300 such that the B tabbed sheets left retained in the sheet feed stage are each discharged onto a sheet discharge tray, e.g., the sheet discharge tray 297, which is different from the sheet discharge tray 293 of the sheet processing unit 290 (step S114). Specifically, the tabbed sheets determined as the surplus tabbed sheets retained in the sheet feed stage are fed in sequence, and the thus fed surplus tabbed sheets are each conveyed via the printer unit 300 to the sheet processing unit 290, without being subjected to image formation. At this time, the surplus tabbed sheets are reversed from front to back and conveyed to the sheet processing unit 290. The sheet processing unit 290 operates to convey the surplus tabbed sheets onto the sheet discharge tray 297, without performing the sheet processing on the surplus tabbed sheets.

After completion of the one set of image formation, the CPU 171 increments the number of sets of output, x, by 1 (step S115), and determines whether or not the number of sets of output, x, is equal to the set number of sets of output, m (step S116). If it is determined that the number x is not equal to the set number m, the CPU 171 returns to step S113 in which it performs control such that the next set of image formation is carried out. On the other hand, if it is determined that the number of sets of output, x, is equal to the set number of sets of output, m, the CPU 171 completes the present process.

If it is determined at step S111 that the relation of A=B is fulfilled, two sets of image formation are carried out by using the A tabbed sheets among the B tabbed sheets. In this case, the CPU 171 determines the number of surplus tabbed sheets, which will be left unused in the second set of image formation, among the surplus tabbed sheets which will be produced in the first set of image formation (step S117 in FIG. 12). Then, the CPU 171 initializes the number of sets of output, x, to 0 (step S118).

Next, the CPU 171 controls the printer unit 300 such that the first set of image formation is carried out (step S119). To this end, as in step S113, the tab images shifted by the image processing unit 170 by the shift amount λ are delivered to the printer unit 300, in which tabbed sheets are fed from one or more tabbed sheet groups which are loaded in the selected sheet feed stage, and the tab images are formed on respective ones of the thus fed tabbed sheets. The tabbed sheets formed with the tab images are conveyed to the sheet processing unit 290, which operates to discharge the tabbed sheets onto, e.g., the sheet discharge tray 293, without performing the sheet processing thereon.

After completion of the one set of image formations the CPU 171 controls the printer unit 300 such that the surplus tabbed sheets determined in step S117 are discharged via the sheet processing unit 290 onto the sheet discharge tray 297 (step S120). In the printer unit 300, the tabbed sheets determined as the surplus tabbed sheets are fed from the selected sheet feed stage and conveyed to the sheet processing unit 290, without being formed with images. The sheet processing unit 290 operates to discharge the tabbed sheets determined as the surplus tabbed sheets to the sheet discharge tray 297, without performing the sheet processing thereon.

After the surplus tabbed sheets are discharged, the CPU 171 controls the printer unit 300 such that the second set of image formation is carried out (step S121). Specifically, the tab images stored in the image memory 103 are read out by the image processing unit 170 in a reverse order from that at the time of image formation for the first set, and the tab images are each rotated by p (rad). The rotated tab images are shifted by the shift amount λ forward in the conveyance direction. The thus processed tab images are delivered to the printer unit 300.

In the printer unit 300, tabbed sheets are fed from one or more tabbed sheet groups which are loaded in the selected sheet feed stage. The thus fed tabbed sheets are conveyed toward the flapper 237 without being formed with images and are introduced by the flapper 237 into the inversion path 239 via the conveyance path 238. The inversion rollers 245 are then reversely rotated, whereby the tabbed sheets are conveyed from the inversion path 239 to the lower conveyance path 240 and introduced via the lower conveyance path 240 to the refeed path 241. The tabbed sheets introduced into the refeed path 241 are conveyed by the refeed rollers 242 toward the registration rollers 233, whereby the tabbed sheets are reversed from front to back, and refed, with the respective tabs positioned forward in the conveyance direction. It should be noted that the surplus tabbed sheets are refed by the refeed rollers 242 in the same order as that in which the surplus tabbed sheets are fed from the selected sheet feed stage.

Next, tab images respectively corresponding to the refed tabbed sheets are formed thereon, and the tabbed sheets formed with the tab images are conveyed to the sheet processing unit 290, without being reversed from front to back unlike at the time of image formation for the first set. The sheet processing unit 290 discharges the tabbed sheets to the sheet discharge tray 292, without performing the sheet processing thereon. As a result, tabbed sheets for the second set are discharged onto the sheet discharge tray 292, with respective image-formation surfaces directed upward and with respective tabs positioned forward in the conveyance direction. These tabbed sheets are stacked from the tabbed sheet corresponding to the last page.

After completion of the second set of image formation, the CPU 171 increments the number of sets of output, x, by 2 (step S122), and determines whether or not the number x of sets of output is equal to or larger than the set number of sets of output, m (step S123). If it is determined that the number x is less than the set number m, the CPU 171 returns to step S119 where it performs control such that the next two sets of image formation are carried out. On the other hand, if it is determined that the number x is equal to or larger than the set number m, the CPU 171 completes the present process.

If the relation of A=B is fulfilled, the two sets of image formation are performed by using the A surplus tabbed sheets. In that case, image formation is sometimes carried out on the sheets which are larger in number by one than the set number of sets of output. Specifically, in a case that the set number of sets of output is an odd number, there are obtained an even number of products which is larger by one than the set number of sets of output. On the other hand, if the set number of sets of output is an even number, there are obtained products which are the same in number as the set number of sets of output.

Figure 13A:
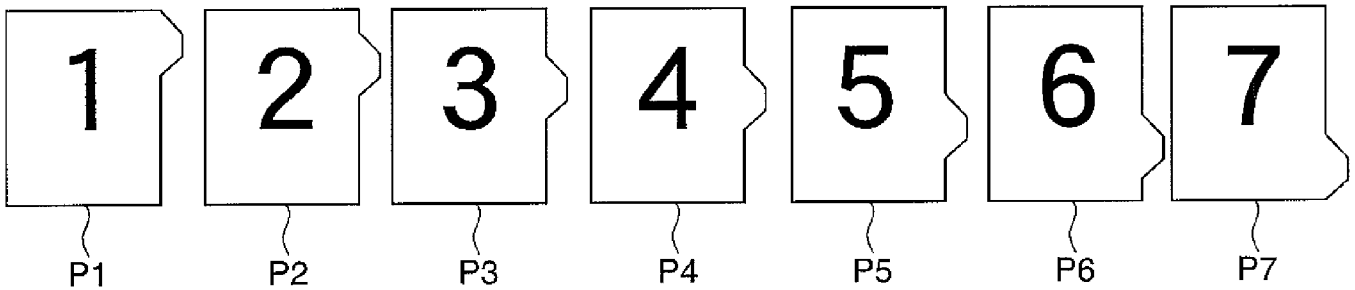
FIGS. 13A to 13C are views showing an example of output of seven tabbed sheets constituting a tabbed sheet group and formed with tab images.
Figure 13B:
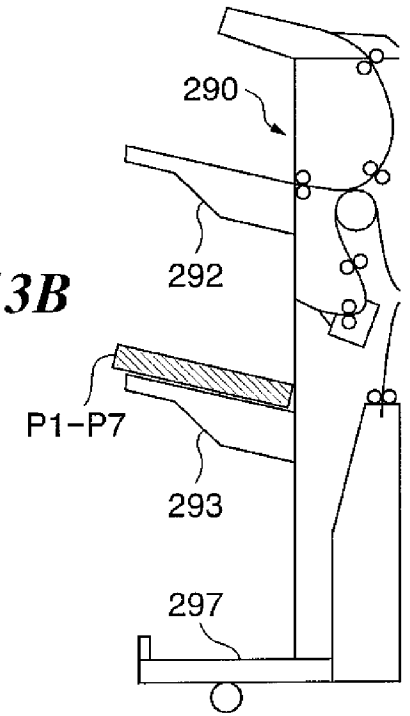
Figure 13C:
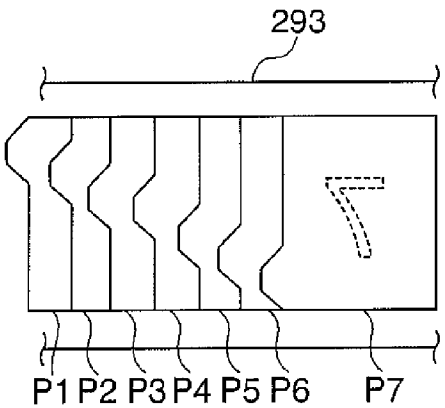

With reference to FIGS. 13A-13C along with FIG. 10, a description will be given of one set of image formation, in which tab images are formed on seven tabbed sheets using a tabbed sheet group consisting of seven tabbed sheets. FIGS. 13A-13C show an example of output of seven tabbed sheets on which tab images are formed using a tabbed sheet group consisting of seven tabbed sheets.

In this case, the number of tabbed sheet groups, G, used for one set of image formation is 1, the number of tabbed sheets, A, which will be used for image formation, among the tabbed sheets constituting one tabbed sheet group used for the image formation, is 7 (step S103 in FIG. 10), and the number of surplus tabbed sheets, B, is 0 (step S104). That is, the number of tabbed sheets used for one set of image formation (the number of tab images) is coincident with the number of tabbed sheets constituting one tabbed sheet group, and no surplus tabbed sheets are produced.

As shown in FIG. 13A, tab images "1" to "7" are respectively formed on the first to seventh tabbed sheets P1-P7 of the tabbed sheet group, and as shown in FIG. 13B, the tabbed sheets P1-P7 are discharged onto the sheet discharge tray 293 (step S107). As shown in FIG. 13C, the tabbed sheets P1-P7 discharged onto the sheet discharge tray 293 are stacked in sequence, with the tabbed sheet P1 disposed at a lowermost position. The tabbed sheets P1-P7 are stacked, with respective image formation surfaces directed downward and with respective tabs positioned forward in the conveyance direction.

Figure 14A:
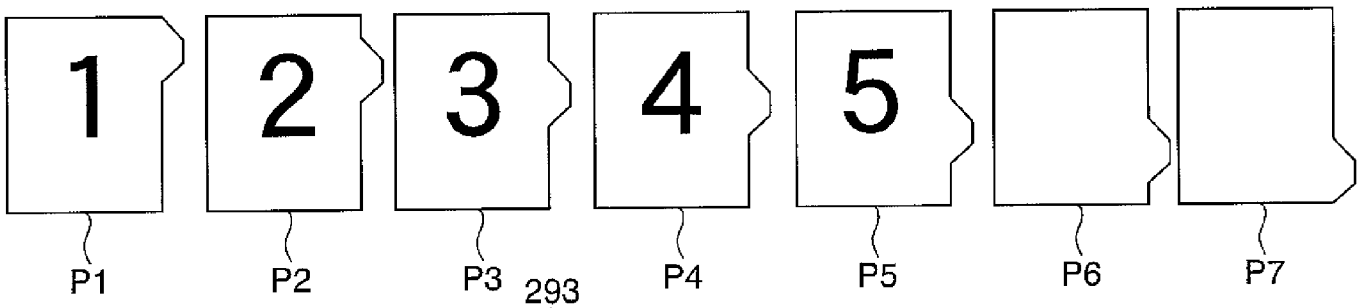
FIGS. 14A to 14C are views showing an example of output of tabbed sheets in a case where tab images are formed on five tabbed sheets using a tabbed sheet group consisting of seven tabbed sheets.
Figure 14B:
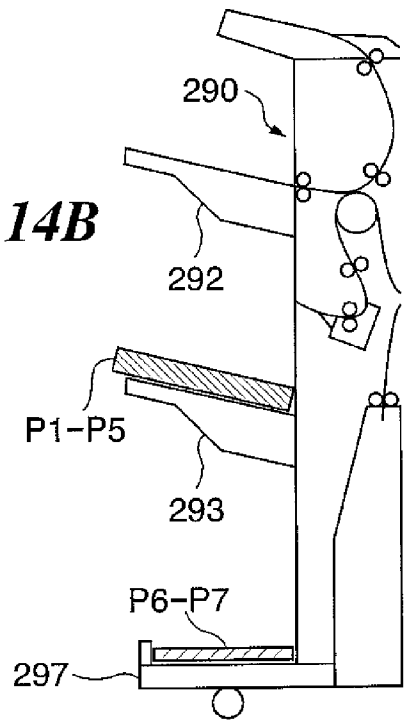
Figure 14C:
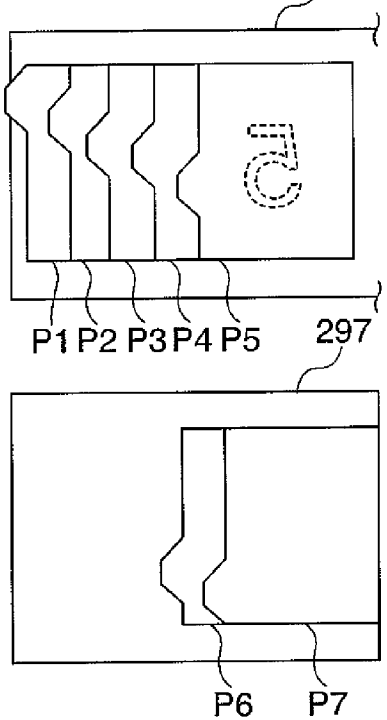

Next, with reference to FIGS. 14A-14C along with FIGS. 10-11, a description will be given of one set of image formation where tab images are formed on five tabbed sheets using a tabbed sheet group consisting of seven tabbed sheets. FIGS. 14A-14C show an example of output of five tabbed sheets on which tab images are formed using a tabbed sheet group consisting of seven tabbed sheets.

In this case, the number of tabbed sheet groups, G, used for one set of image formation is 1, and the number of tabbed sheets, A, used for image formation is 5 (step S103 in FIG. 10). The number of surplus tabbed sheets, B, is 2 (step S104). Thus, the relation of A=B is not fulfilled (step S111 in FIG. 11).

As shown in FIG. 14A, therefore, tab images "1" to "5" are respectively formed on the first to fifth tabbed sheets P1-P5 among the seven tabbed sheets P1-P7 of the tabbed sheet group, and as shown in FIG. 14B, the tabbed sheets P1-P5 are discharged onto the sheet discharge tray 293 (step S113). After completion of the one set of image formation, the sixth and seventh tabbed sheets P6-P7, which are surplus tabbed sheets, are discharged onto the sheet discharge tray 297 (step S114).

As shown in FIG. 14C, the tabbed sheets P1-P5 discharged onto the sheet discharge tray 293 are stacked in sequence, with the tabbed sheet P1 disposed at a lowermost position. The tabbed sheets P1-P5 are stacked with respective image formation surfaces directed downward and with respective tabs positioned forward in the conveyance direction. The sixth and seventh tabbed sheets P6-P7 discharged onto the sheet discharge tray 297 as being surplus tabbed sheets are stacked in sequence, with the tabbed sheet P6 positioned at a lowermost position. The tabbed sheets P6-P7 are stacked with respective tabs positioned forward in the conveyance direction.

Figure 15:
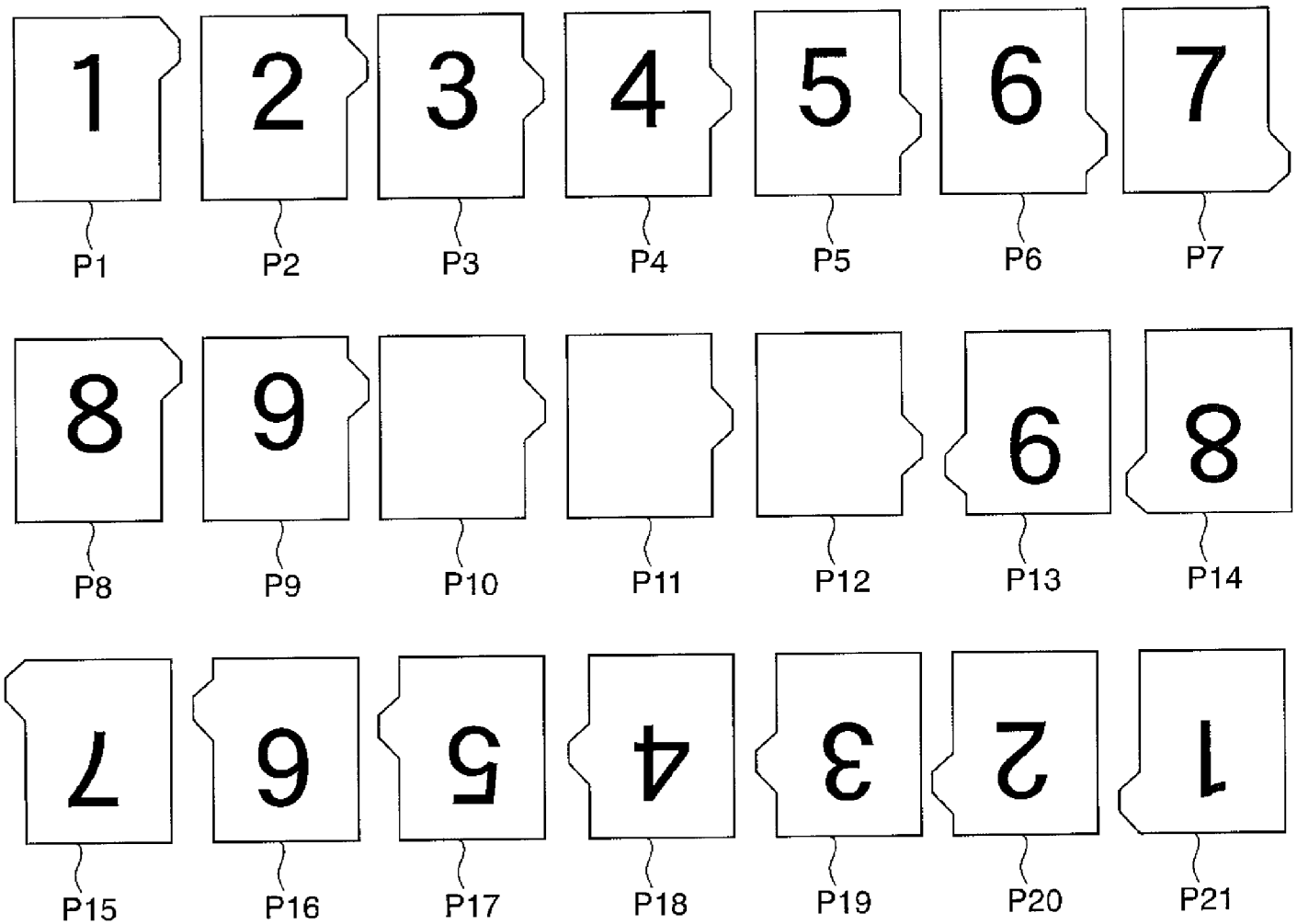
FIG. 15 is a view showing an example of output of tabbed sheets in a case where tab images are formed on nine tabbed sheets using a plurality of tabbed sheet groups each consisting of seven tabbed sheets.
Figure 16A:
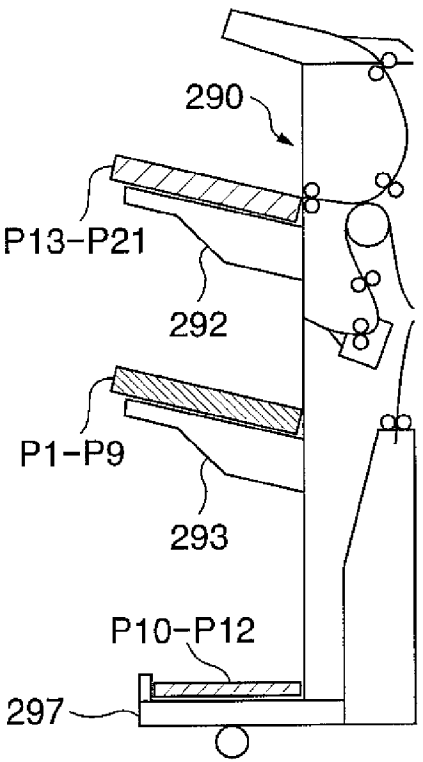
FIGS. 16A and 16B are views showing a state of discharge of the tabbed sheets shown in FIG. 15.
Figure 16B:
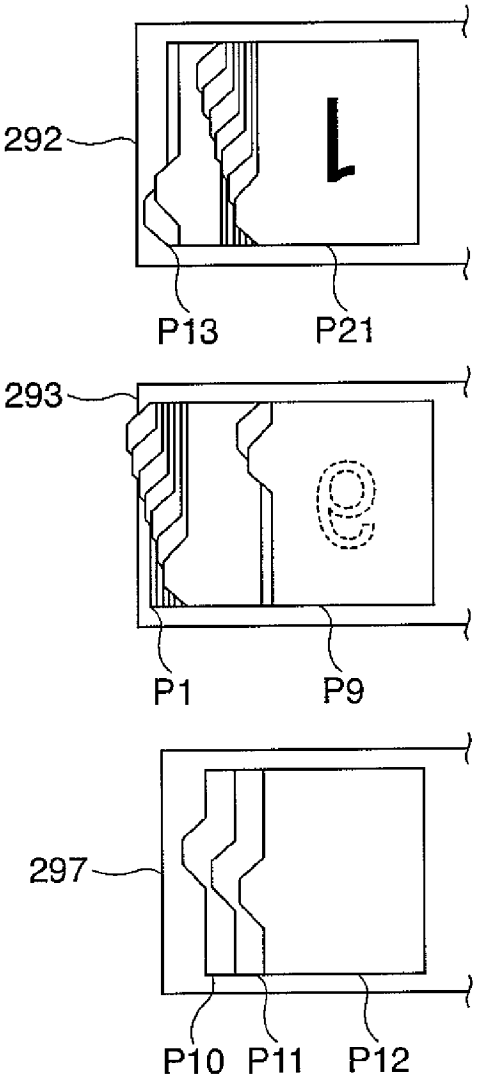

Next, with reference to FIGS. 15, 16A and 16B along with FIGS. 10-12, a description will be given of one set of image formation where tab images are formed on nine tabbed sheets using a plurality of tabbed sheet groups each consisting of seven tabbed sheets. FIG. 15 shows an example of output of nine tabbed sheets on which tab images are formed using a plurality of tabbed sheet groups each consisting of seven tabbed sheets. FIGS. 16A and 16B show a state of discharge of the tabbed sheets P1-P21 shown in FIG. 15.

In this case, the number of tabbed sheet groups, G, used for one set of image formation is 2, and the number of tabbed sheets, A, used for image formation among tabbed sheets constituting a second tabbed sheet group is 2 (step S103 in FIG. 10). Surplus tabbed sheets are the third to seventh five tabbed sheets in the second tabbed sheet group. Thus, the number of surplus tabbed sheets, B, is 5 (step S104). The relation of A=B is therefore fulfilled (step Sill in FIG. 11), and two sets of output are performed by using the B tabbed sheets and the next tabbed sheet group (steps S117 to S123 in FIG. 12).

Among the surplus tabbed sheets in the first set of image formation, tabbed sheets which will be surplus tabbed sheets in the second set of image formation are the third to fifth three tabbed sheets in the second tabbed sheet group (step S117).

As shown in FIG. 15, in the first tabbed sheet group in the first set of output (step S119), tab images "1" to "7" are respectively formed on the first to seventh tabbed sheets P1-P7. Tab images "8" and "9" are respectively formed on the first and second tabbed sheets P8-P9 among the seven tabbed sheets P8-P14 of the second tabbed sheet group. The tab images "1" to "9" are shifted in advance by the shift amount λ toward backward in the conveyance direction.

As shown in FIG. 16A, the tabbed sheets P1-P9 are discharged in sequence onto the sheet discharge tray 293 in a state they are reversed from front to back. As shown in FIG. 16B, the tabbed sheets P1-P9 are stacked in sequence onto the sheet discharge tray 293, with the first tabbed sheet P1 located at a lowermost position.

Upon completion of the first set of output, the tabbed sheets P10-P12 which will be surplus tabbed sheet in the second set of image formation are discharged in sequence onto the sheet discharge tray 297 in a state they are reversed from front to back, as shown in FIGS. 16A and 16B (step S120).

Upon completion of discharge of the surplus tabbed sheets, the second set is output (step S121). Tab images stored in the image memory 103 are subjected to sorting, rotation by p (rad), and movement by the shift amount λ toward forward in the conveyance direction.

The tabbed sheets fed from the sheet feed stage are reversed from front to back and are refed. The processed tab images are formed on the rear surfaces of the refed tabbed sheets. Specifically, as shown in FIG. 15, tab images "9" to "1" are respectively formed on the sixth and seventh tabbed sheets P13-P14 of the second tabbed sheet group and the first to seventh tabbed sheets P15-P21 of a third tabbed sheet group.

As shown in FIG. 16A, the tabbed sheets P13-P21 are discharged in sequence onto the sheet discharge tray 292, without being reversed from front to back. As shown in FIG. 16B, the tabbed sheets P13-P21 are stacked on the sheet discharge tray 292, with the tabbed sheet P13 located at a lowermost position.

Figure 17:
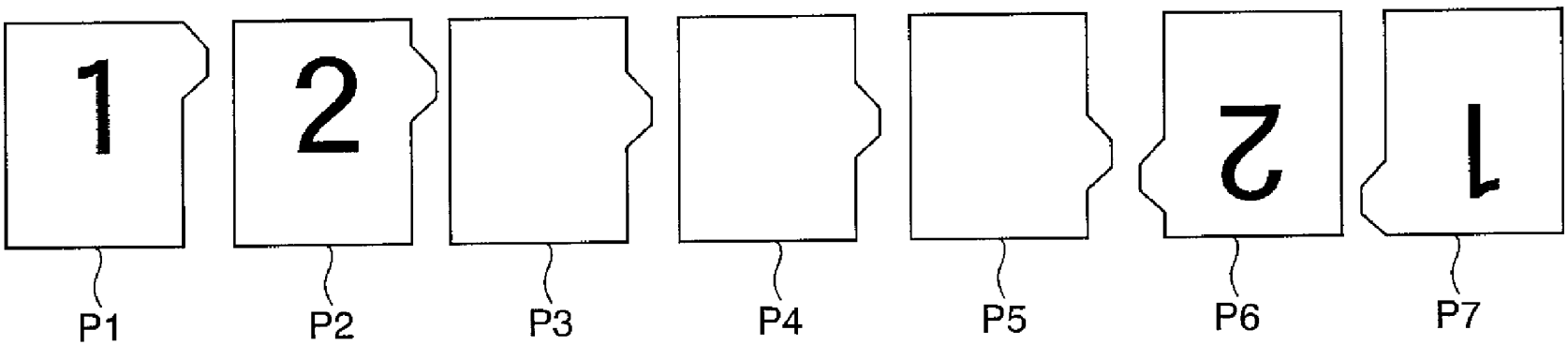
FIG. 17 is a view showing an example of output of tabbed sheets in a case where tab images are formed on two tabbed sheets using a tabbed sheet group consisting of seven tabbed sheets.
Figure 18A:
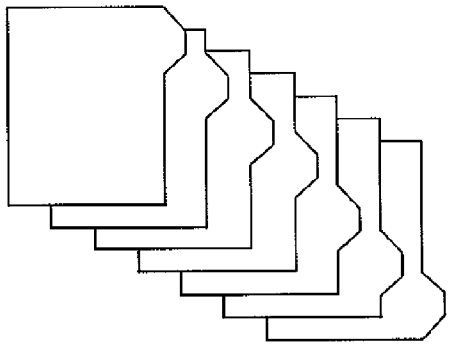
FIGS. 18A and 18B are views each showing how tabbed sheets are arranged in a tabbed sheet group consisting of seven tabbed sheets.
Figure 18B:
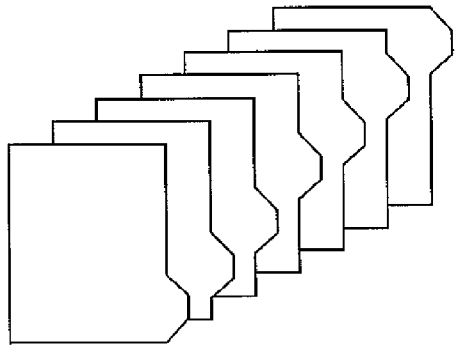
Figure 19:
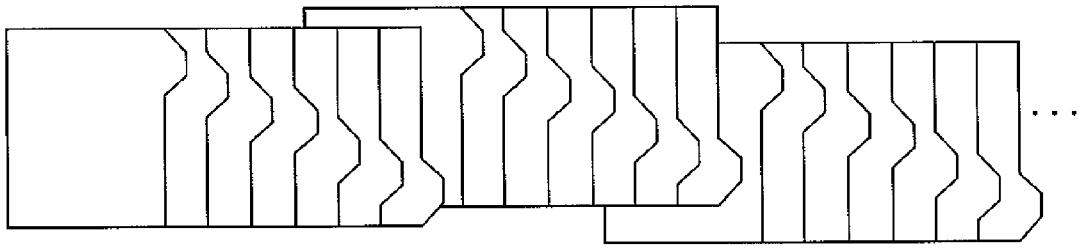
FIG. 19 is a view schematically showing how a plurality of tabbed sheet groups are loaded on a sheet feed tray of an image forming apparatus.
Figure 20:
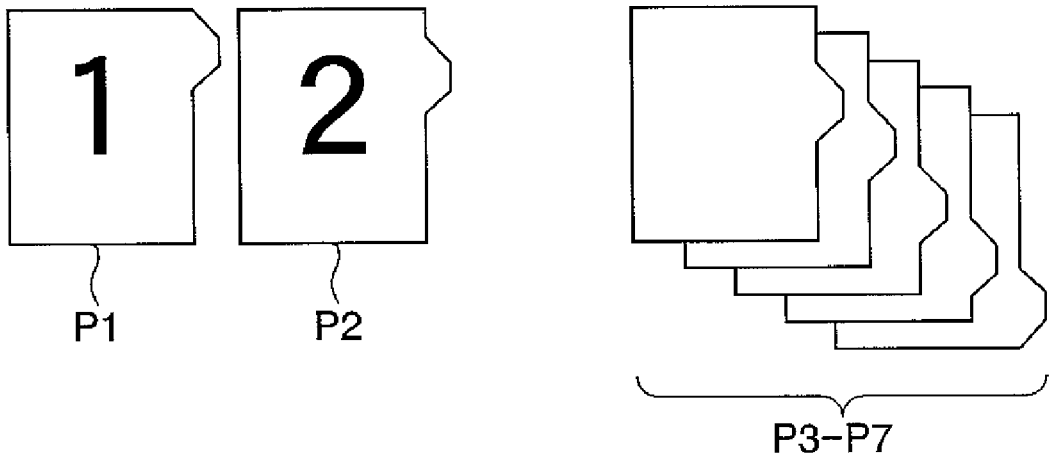
FIG. 20 is a view showing an example of image formation on two tabbed sheets by using a tabbed sheet group consisting of seven tabbed sheets.
Figure 21:
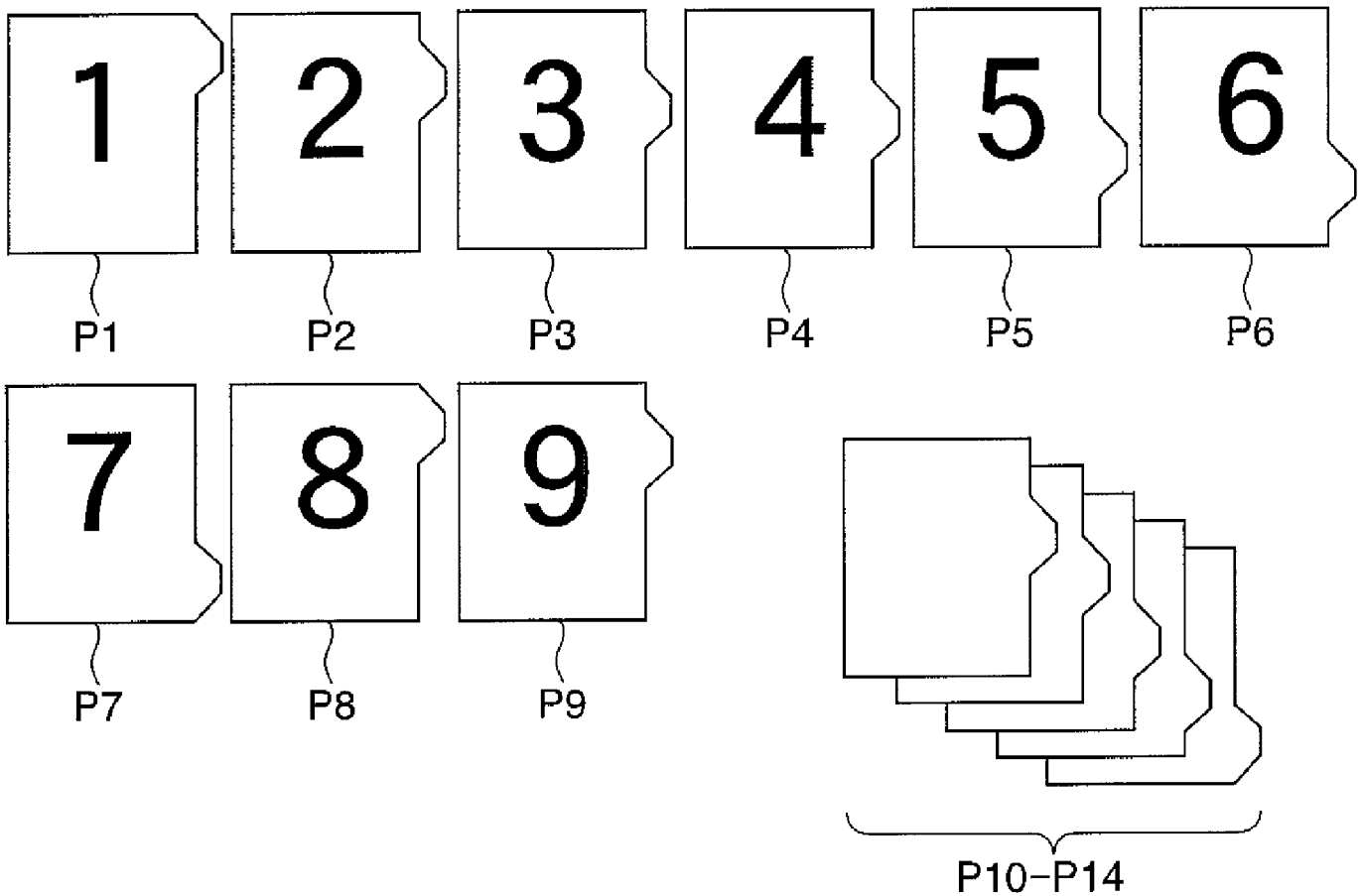
FIG. 21 is a view showing an example of image formation on nine tabbed sheets by using a plurality of tabbed sheet groups each consisting of seven tabbed sheets.

Next, with reference to FIG. 17 along with FIGS. 10-12, a description will be given of a case where tab images are formed on two tabbed sheets using a tabbed sheet group consisting of seven tabbed sheets. FIG. 17 shows an example of output of two tabbed sheets on which images are formed using a tabbed sheet group consisting of seven tabbed sheets.

In this case, the number of tabbed sheet groups, G, used for one set of image formation is 1, and the number of tabbed sheets, A, used for image formation is 2 (step S103 in FIG. 10). Surplus tabbed sheets are the third to seventh five tabbed sheets of a first tabbed sheet group, and the number of the surplus tabbed sheets, B, is 5 (step S104). The relation of A=B is therefore fulfilled (step S111 in FIG. 11), and two sets of output are carried out using the B tabbed sheets (steps S117 to S123 in FIG. 12). Among the surplus tabbed sheets in the first set of image formation, tabbed sheets are determined which will be surplus tabbed sheets in the second set of image formation (step S117). In this example, tabbed sheets which will be surplus tabbed sheets in the second set of image formation are the third to fifth three tabbed sheets in the first tabbed sheet group.

As shown in FIG. 17, in the first set of output (step S119), tab images "1" and "2" are respectively formed on the first and second tabbed sheets P1-P2 of the first tabbed sheet group. The tab images "1" and "2" are shifted in advance by the shift amount λ toward backward in the conveyance direction. The tabbed sheets P1-P2 are discharged onto the sheet discharge tray 293 of the sheet processing unit 290 in a state they are reversed from front to back.

After completion of the first set of image formation, the tabbed sheets P3-P5 which will become surplus tabbed sheets in the second set of image formation are discharged in sequence onto the sheet discharge tray 297 in a state they are reversed from front to back (step S120).

After the surplus tabbed sheets are discharged, the second set of image formation is carried out (step S121). Specifically, tab images stored in the image memory 103 are subjected to sorting, rotation by p (rad), and movement by the shift amount λ toward forward in the conveyance direction. The tabbed sheets P6-P7 fed from the sheet feed stage are reversed from front to back and are refed. The processed tab images are respectively formed on the rear surfaces of the refed tabbed sheets P6-P7, which are then discharged in sequence onto the sheet discharge tray 292, without being reversed from front to back.

As described above, according to this embodiment, surplus tabbed sheets produced in one set of output are reutilized for the next set of output, without requiring the user to perform laborious task.

In this embodiment, the case where tab images are read from originals has been described. Alternatively, tab images produced by an external information processing apparatus, such as for example a personal computer connected to the external I/F processing unit 104, may be input and stored into the image memory 103. In that case, designation of the tabbed sheet creation mode, selection of a sheet feed stage (operation screen 1300), setting of the number of tabs (operation screen 1310), and setting of the shift amount λ (operation screen 1320) are performed by a printer driver installed on the information processing apparatus.

It is to be understood that the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2007-262526, filed Oct. 5, 2007, which is hereby incorporated by reference herein in its entirety.

What is claimed is:

1. An image forming apparatus comprising:

a feeding unit adapted to store at least one tabbed sheet group, each of the at least one tabbed sheet group consisting of a plurality of tabbed sheets having tabs formed therein at different positions, said feeding unit being adapted to feed the stored tabbed sheets;

a refeeding unit adapted to reverse front and back sides of the tabbed sheets fed from said feeding unit and adapted to feed the reversed tabbed sheets;

an image processing unit adapted to perform rotation processing to rotate an image to a predetermined direction and perform sorting processing to sort images to be formed on a plurality of tabbed sheets into a predetermined order; and a control unit adapted to control the image forming apparatus and adapted to determine a number of tabbed sheets constituting one tabbed sheet group and a number of tabbed sheets which will be used for image formation for a first set among the tabbed sheets constituting the one tabbed sheet group, wherein said control unit is adapted to determine a number of surplus tabbed sheets which will be left unused for the image formation for the first set among the tabbed sheets constituting the one tabbed sheet group in accordance with the determined number of tabbed sheets constituting the one tabbed sheet group and the determined number of the tabbed sheets which will be used for the image formation for the first set, and in a case where the number of the tabbed sheets which will be used for the image formation for the first set is not greater than the determined number of surplus tabbed sheets, said control unit is adapted, at a time of image formation for a second set, to make control such that the rotation processing and the sorting processing are performed by said image processing unit, front and back sides of the surplus tabbed sheets are reversed and the reversed surplus tabbed sheets are fed by said refeeding unit, and images subjected to the rotation processing and the sorting processing are formed on the surplus tabbed sheets by said image processing unit.

2. The image forming apparatus according to claim 1, wherein said control unit is adapted to determine a number of second surplus tabbed sheets which will be left unused for image formation for the second set, among the surplus tabbed sheets which will be left unused for the image formation for the first set, and said control unit make control such that the image information for the first set, discharge of the second surplus tabbed sheets, and the image information for the second set are performed in this order.

3. The image forming apparatus according to claim 2, including:

a sheet discharge unit having a plurality of sheet discharge trays and adapted to selectively discharge the tabbed sheets to any of the plurality of sheet discharge trays, wherein said control unit controls said sheet discharge unit such that tabbed sheets used in the image formation for the first set, the second surplus tabbed sheets, and tabbed sheets used in the image formation for the second set are discharged to different ones of the sheet discharge trays.

4. The image forming apparatus according to claim 1, wherein said feeding unit is adapted to store the tabbed sheet group such that a tab-formed side of the tabbed sheets extends in a direction perpendicular to a direction of conveyance of the tabbed sheets.

5. The image forming apparatus according to claim 1, wherein said refeeding unit is adapted to refeed the surplus tabbed sheets in an order in which the surplus tabbed sheets are fed by said feeding unit.

6. A control method for an image forming apparatus in which tabbed sheets fed from at least one tabbed sheet group are respectively formed with images and the tab sheets formed with the images are output, each of the at least one tabbed sheet group consisting of a plurality of tabbed sheets having tabs formed therein at different positions, the control method comprising:

a first determination step of determining number of the tabbed sheets constituting one tabbed sheet group and determining number of tabbed sheets which will be used for image formation for a first set among the tabbed sheets constituting the one tabbed sheet group;

a second determination step of determining number of surplus tabbed sheets which will be left unused for the image formation for the first set among the tabbed sheets constituting the one tabbed sheet group in accordance with the determined number of tabbed sheets constituting the one tabbed sheet group and the determined number of the tabbed sheets which will be used for the image formation for the first set; and a control step of making, in a case where the number of the tabbed sheets which will be used for the image formation for the first set is not greater than the determined number of surplus tabbed sheets, control such that image information for a second set is performed using the surplus tabbed sheets, wherein said control step includes:

an image processing step of performing rotation processing to rotate at least one image to be formed on at least one surplus tabbed sheet to a predetermined direction and performing sorting processing to sort the at least one image into a predetermined order, a refeeding step of reversing front and back sides of the at least one surplus tabbed sheet and refeeding the reversed surplus tabbed sheet, and an image forming step of forming the at least one image subjected to the rotation processing and the sorting processing on the at least one surplus tabbed sheet refed in said refeeding step.

* * * * *